US012774640B2

(12) United States Patent
Knight et al.

(10) Patent No.: US 12,774,640 B2
(45) Date of Patent: Oct. 27, 2026

(54) ARTICULABLE COUPLINGS FOR DOWNHOLE TOOLS

(71) Applicant: G&H Diversified Manufacturing LP, Houston, TX (US)

(72) Inventors: Benjamin Knight, Katy, TX (US); Steven Zakharia, Houston, TX (US); Ryan Ward, Tomball, TX (US); Aidan K. Gale, Katy, TX (US); William D. Freeman, Mineola, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 0 days.

(21) Appl. No.: 19/312,232

(22) Filed: Aug. 27, 2025

(65) Prior Publication Data

US 2026/0063003 A1 Mar. 5, 2026

Related U.S. Application Data

(60) Provisional application No. 63/687,749, filed on Aug. 27, 2024.

(51) Int. Cl.
*E21B 17/02* (2006.01)

(52) U.S. Cl.
CPC ..... *E21B 17/028* (2013.01); *E21B 17/023* (2013.01)

(58) Field of Classification Search
CPC ..... E21B 17/023; E21B 17/028
See application file for complete search history.

(56) References Cited

U.S. PATENT DOCUMENTS 3,475,039 A * 10/1969 Ortloff ..... F16L 27/04 285/94
4,753,291 A * 6/1988 Smith ..... E21B 34/06 166/65.1
4,858,705 A * 8/1989 Thiery ..... E21B 7/068 175/45
5,295,848 A * 3/1994 Mohn ..... E21B 33/0355 439/247
2017/0370198 A1* 12/2017 Delchambre ..... E21B 28/00

* cited by examiner

*Primary Examiner* — David Carroll
(74) *Attorney, Agent, or Firm* — Conley Rose, P.C.

(57) ABSTRACT

A swivel assembly includes a first member having a first throughbore, a second member having a second throughbore, a flexible joint coupled between the first member and the second member that permits at least one of the first member and the second member to rotate an unlimited number of rotations relative to the other and that also connects the first throughbore and the second throughbore such that an electrical signal pathway for receiving an electrical signal conductor is formed that extends continuously through the flexible joint and between the first throughbore and the second throughbore, and a pressure bulkhead positioned along the electrical signal pathway that divides the electrical signal pathway into a pressure exposed zone that is exposed to external pressure from the surrounding environment and a pressure isolated zone that is isolated from the external pressure.

24 Claims, 26 Drawing Sheets

ARTICULABLE COUPLINGS FOR DOWNHOLE TOOLS

CROSS REFERENCE TO RELATED APPLICATIONS

This application claims benefit of U.S. provisional patent application Ser. No. 63/687,749 filed Aug. 27, 2024, and entitled "Bend Flexible Tandem Sub," which is hereby incorporated herein by reference in its entirety for all purposes.

STATEMENT REGARDING FEDERALLY SPONSORED RESEARCH OR DEVELOPMENT

Not applicable.

BACKGROUND

Perforating tool strings are sometimes used to form one or more perforations in a cased wellbore extending through a subterranean formation whereby fluid communication may be established between the subterranean formation and the cased wellbore. For instance, the fluid communication established by the perforations may be used to deliver fracturing or other fluids to the subterranean formation to treat the formation for maximizing the subsequent production of hydrocarbons from the completed wellbore. As part of this process, the perforating tool string is deployed from a surface assembly vertically (which often turns horizontal in the case of deviated or horizontal wellbores) down into the wellbore to a desired location therein for perforating the cased wellbore.

In some applications, it may be desirable for the perforating tool string to exhibit bending flexibility during the operation thereof. For instance, such bending flexibility may be beneficial for handling the perforating tool string at the surface, or when the cased wellbore has bends or deviations where bending tolerance would be helpful in delivering the perforating tool string into the wellbore, transporting the perforating tool string downhole through the cased wellbore, and for later pulling it back out of the cased wellbore. Currently, perforating tools, or simply "perf guns" as they are commonly called, of perforating tool strings are connected by substantially strong and rigid tandem subs which are formed from solid steel ingots and machined to connect a pair of perforating tools together. The size and strength of such tandem subs does not tolerate much bending and mostly in the very small amount of slack between the connecting threads of the perforating tools to the tandem subs. Additionally, tandem subs are generally designed to hold pressure within the air filled perforating tool against the high liquid pressures downhole.

It would be desirable to have a tandem sub that could hold pressure for a perforating tool that could also tolerate bending of approximately five degrees or more to provide for flexible operations in the field.

SUMMARY OF THE DISCLOSURE

This disclosure relates to a tandem sub for connecting tools in a downhole tool string including a bravo member or bar, an alpha member or bar and a ball connection between the bravo bar and the alpha bar where both the bravo bar and alpha bar include a throughbore for carrying an insulated wire. The wire is connected at least at one end to extend through the throughbore in a manner that permits translation movement within the throughbore and maintain continuous electrical conductivity.

The disclosure further relates to a tandem sub for connecting tools in a downhole tool string including a bravo bar, a alpha bar and a ball connection between the bravo bar and the alpha bar where both the bravo bar and alpha bar include a throughbore for carrying an insulated wire. The ball is exposed to the downhole environment while the tandem sub seals out the environment from the tools in the downhole tool string.

In a different view, the disclosure relates to a perforating tool string including a first perforating tool, a second perforating tool, a bravo bar connected to the first perforating tool, an alpha bar connected to the second perforating tool and a ball connection between the bravo bar and the alpha bar where both the bravo bar and alpha bar include a throughbore for carrying an insulated wire. The ball connection providing bend flexibility between the first and second perforating tools. The ball in this arrangement is exposed to the downhole environment while the tandem sub seals out the environment from the perforating tools in the perforating tool string.

BRIEF DESCRIPTION OF THE DRAWINGS

For a detailed description of exemplary embodiments of the disclosure, reference will now be made to the accompanying drawings in which.

DETAILED DESCRIPTION

Figure 1:
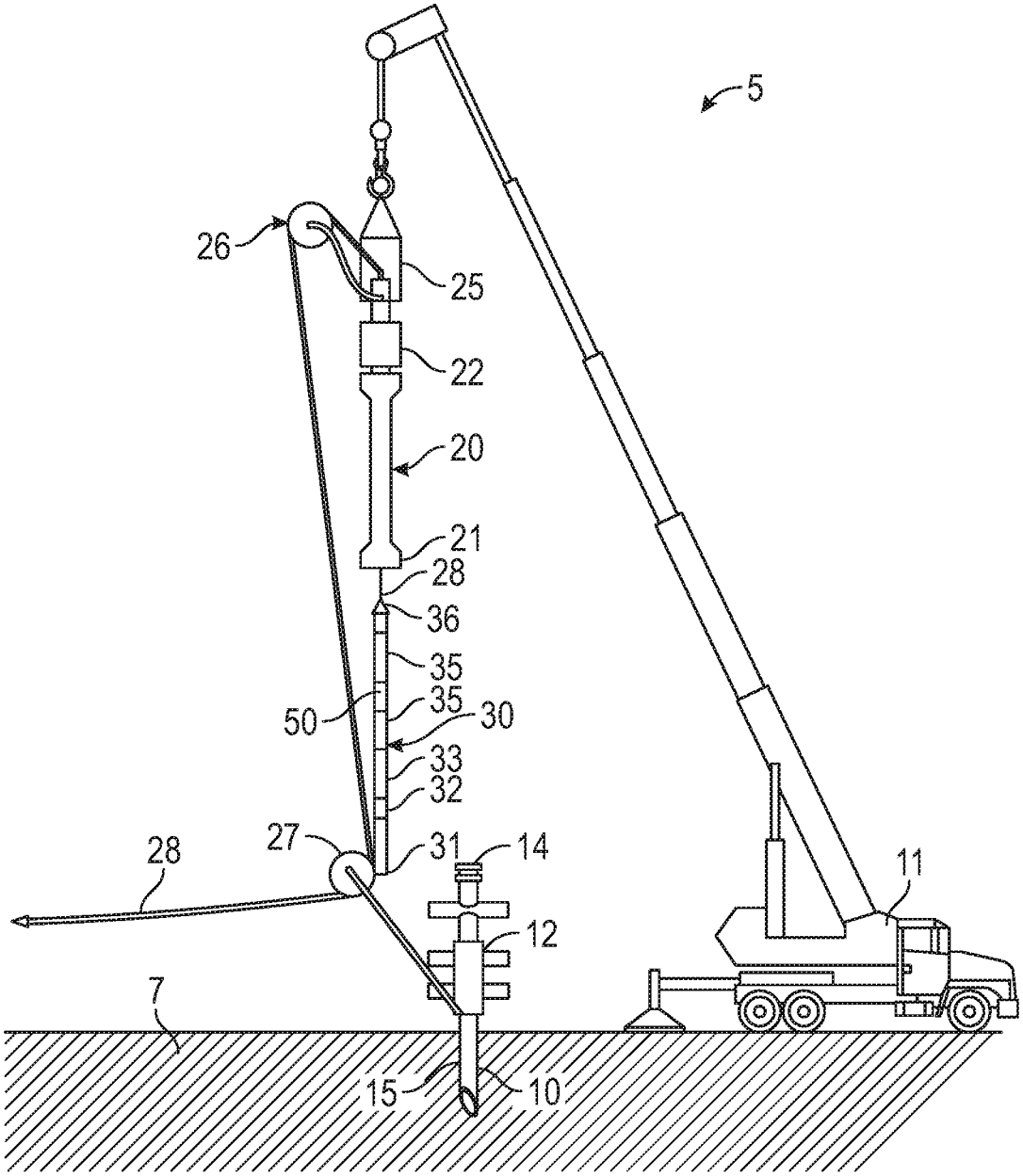
FIG. 1 (Prior Art)
FIG. 1 is a prior art elevation view of a wellsite with a crane lifting a wireline lubricator with a tool string suspended below about to be pulled into the wireline lubricator so that after the lubricator is re-attached to the wellhead, the tool string may be inserted into a wellbore.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

Referring now to FIG. 1, a wireline system 5 is shown for deploying a tool string 30 into a cased wellbore 10 in which a casing string or casing string 15 is installed. The view shown in FIG. 1 is near the surface 7 with the cased wellbore 10 extending far into the earth and potentially into a generally long horizontal run through a hydrocarbon bearing formation typically after taking one or more bends like at heel 16 of the cased wellbore 10. A surface rig or crane 11 of the wireline system 5 is positioned adjacent the cased wellbore 10 for lifting a wireline lubricator 20 off the top of the valve tree 12 in preparation for lifting a tool string 30 up into the lubricator 20 to begin the process of deploying the tool string 30 into the wellbore. Wireline 28 of the wireline system 5 is fed through the wireline lubricator 20 to pull the tool string 30 up into the wireline lubricator 20 whereupon the wireline lubricator 20 is then attached onto the top of a valve tree 12 whereby a bottom coupling 21 of lubricator 20 sealingly connects to a coupling 14 at the top of the valve tree 12.

In the configuration shown in FIG. 1, the cased wellbore 10 is sealed by one or more valves of the valve tree 12. As is well known, pressure within cased wellbore 10 must be maintained in a controlled state at all times so that before any valve is opened to the atmosphere, others are closed in a manner that maintains well pressure control. The position of wireline lubricator 20 is controlled by an operator of the crane 11 using a bridle 25 attached to an upper end of the wireline lubricator 20, while the position of tool string 30 is controlled by an operator of a wireline truck (not shown) via the wireline 28. In FIG. 1, the wireline operator has reeled in the wireline 28 to lift the tool string 30 off of the surface 7 into a vertical orientation such that an upper end of the tool string 30 is proximal to the bottom of a wireline sealing element 22 at the bottom end of the wireline lubricator 20. The entire length of tool string 30 must fit fully into the wireline lubricator 20 to allow the bottom coupling 21 of wireline lubricator 20 to sealingly connect to the coupling 14 of valve tree 12 to maintain well pressure control prior to insertion of the tool string 30 into the cased wellbore 10 through the valve tree 12.

The tool string 30 includes a number of tools that are selected by an operator of the cased wellbore 10 and which, in this example, includes a plug 31 at the bottom thereof, an adapter kit 32 and a setting tool 33 where the adapter kit 32 is connected between the plug 31 and setting tool 33. Above the setting tool 33 are a number of perforating tools 35 along with other tools that provide electronic communication with the setting tool 33 and the perforating tools 35 and with other tools of tool string 30 that provide location data for the tool string 30 and serve in other functions. At the top of the tool string 30 is a coupling device that attaches to the wireline 28. The wireline 28 extends from the wireline truck, over a pair of sheaves 26 and 27, and runs into the top of the lubricator 20 via a wireline sealing element 22 of the wireline lubricator 20. Wireline 28 is typically quite long to permit the tool string 30 to run potentially miles through the cased wellbore 10. It may be understood that wellbores, including cased wellbore 10, extend vertically downwards from the surface 7 and then curve around a heel 16 and extend horizontally a great distance (e.g., a mile or more) through a hydrocarbon bearing zone in the earthen formation.

Figure 2:
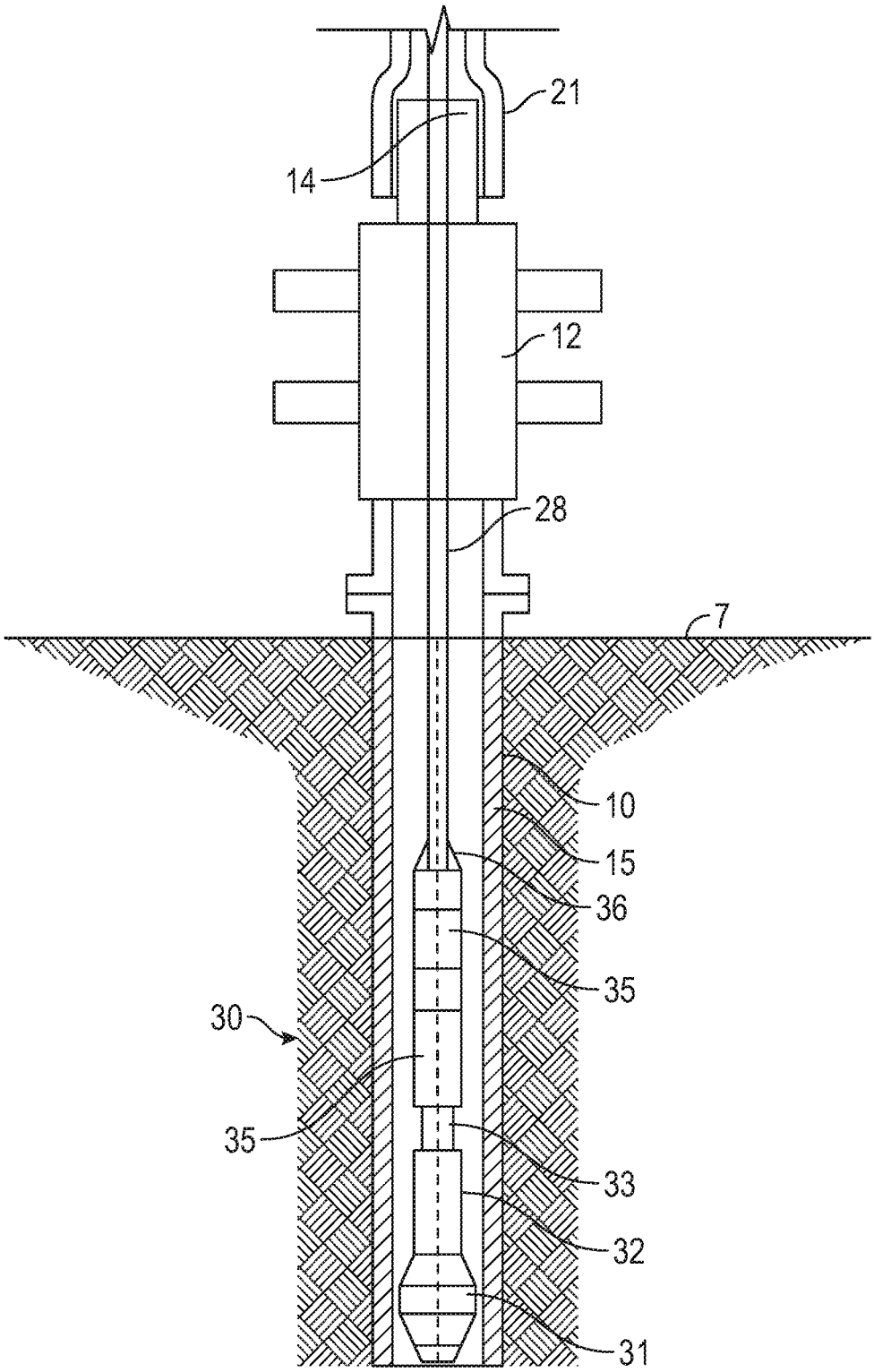
FIG. 2 (Prior Art)
FIG. 2 shows a conventional perforating tool string inserted into the well and progressing toward the bottom of the wellbore.

Turning briefly to FIG. 2, the tool string 30 is shown following its insertion through and past the valves in the valve tree 12 such that the tool string 30 is positioned inside a vertical section of the cased wellbore 10 where well pressure is under the control of the wireline sealing element 22 (not shown in FIG. 2). The tool string 30 is lowered through the cased wellbore 10 by the wireline system 5 until the tool string 30 reaches a predetermined depth or until the wellbore has turned sufficiently horizontal that gravity no longer overcomes the drag and friction between the casing and the tool string 30. At that point, pumps are employed to pump fluid down the wellbore and hydraulically push the tool string 30 toward its intended destination.

Figure 3:
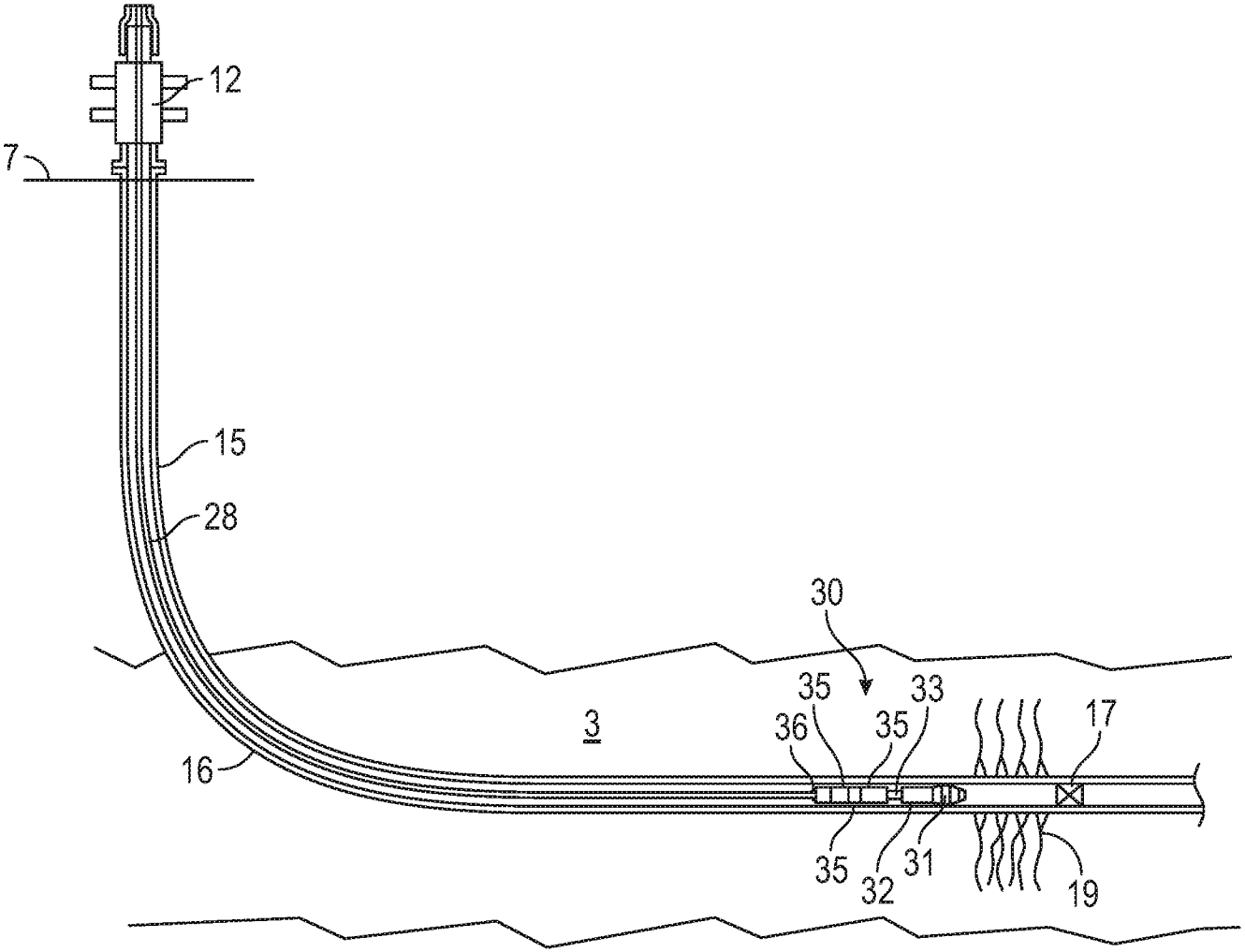
FIG. 3 (Prior Art)
FIG. 3 shows a well with a perforating tool string approaching existing perforations that were recently hydraulically fractured and the plug that was carried into the well by the prior perforating tool string.

Referring to FIG. 3, the tool string 30 is shown located at the intended destination. Once there, the plug 31 of tool string 30 is set so that later, when fluid pressure is applied by a fracking system (not shown) from the surface 7, the fluid pressure is focused and limited to perforations created in the cased wellbore 10 above the set plug 31. The isolation provided by the set plug 31 prevents the fluid pressure from the surface-based fracking system to pass easily into other perforations located downhole from the plug 31 that are already opened from a prior fracking cycle.

In FIG. 3, the plug 31 is shown as set but not yet disconnected from the remainder of the tool string 30 which is uphole from the plug 31. The plug 31 is set and firmly anchored to the casing string 15 to seal the cased wellbore 10. Particularly, in this example, plug 31 seals a downhole production zone extending downhole from plug 31 to a previously set plug 17 (deployed and set using a previous tool string). It may be understood that perforations 19 associated with the downhole production zone have previously been fracked and enlarged prior to the deployment of tool string 30 into cased wellbore 10. As such, it may be understood that additional fracked production zones (not shown in FIG. 3) are formed downhole from the plug 17.

Figure 4:
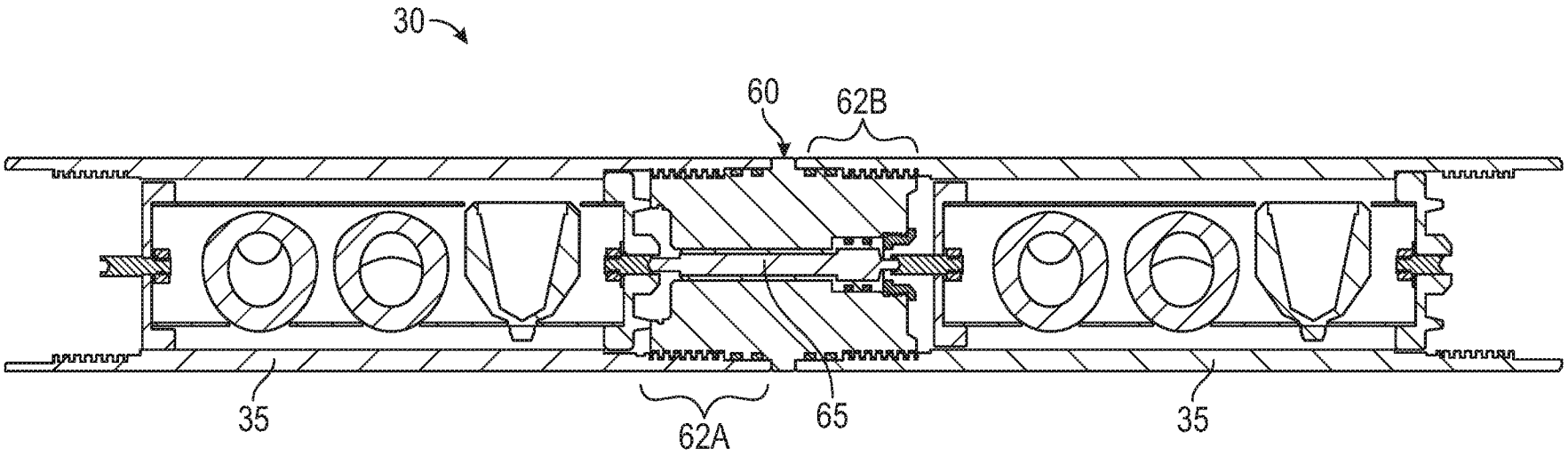
FIG. 4 (Prior Art)
FIG. 4 is a cross-sectional view of a prior art arrangement of a pair of hydrocarbon recovery perforating tools coupled together by a conventional tandem sub.

FIG. 4 shows a two perforating tools 35 connected by a tandem sub 60. The tandem sub 60 includes a bolt thread and seal assembly 62A to connect to the left perforating tool 35 while also including a second, mirror image bolt thread and seal assembly 62B for connecting to the right perforating tool 35. The tandem sub 60 further includes an axial bore hole with a combination bulkhead and insulated conductive bar 65 positioned therein to provide pressure isolation between the two perforating tools 35 and also carry electric signals and power through the tandem sub 60 between the two perforating tools 35. The tandem sub 60 is made of heavy steel and does not allow much, if any bending of the perforating tools relative to one another.

For the sake of clarity and consistency, the uphole end of the articulable coupling and all components of a tool string are shown at the left of the drawings while the downhole end is shown at the right of the drawings. Additionally, the letters "A" and "B" and "Alpha" and "Bravo" are used herein to generally orient uphole to downhole although in most instances, these coupling may be oriented in the opposite direction except where connections such as for electric connections are different at the uphole end versus the downhole end.

Figure 5:
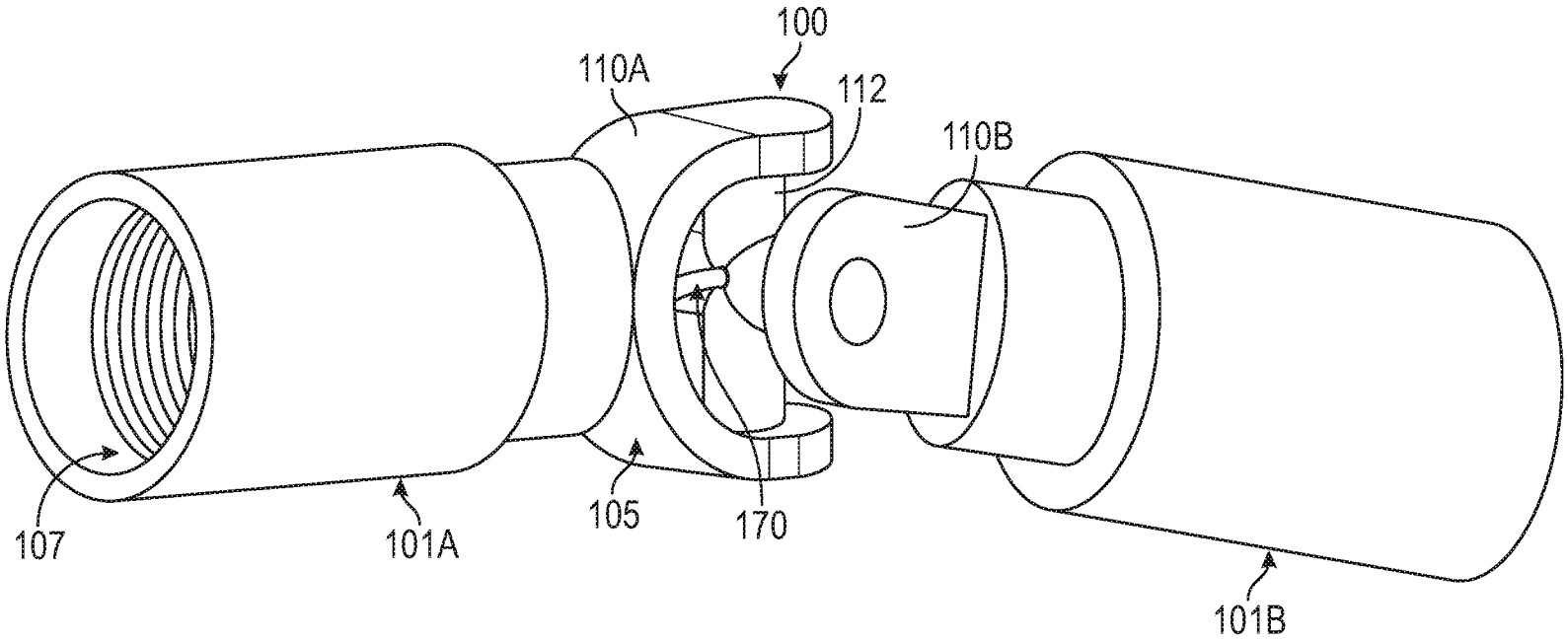
FIG. 5 is a perspective view of a first embodiment of an articulable coupling for providing bend flexibility and electric communication to a perforating tool string.

Turning now to FIG. 5, a first exemplary embodiment of a swivel or articulable coupling indicated by arrow 100 is shown that includes a universal joint. Particularly, the articulable coupling comprises a spider and a pair of yokes 110A and 110B articulable connected to the spider 112. In some embodiments, the spider 112 and pair of yokes 110A and 110B define a flexible joint 105 of the articulable coupling 100. Additionally, yokes 110A and 110B are connected (e.g., threadably connected) to connecting members or bars 101A and 101B to connect the yokes 110A and 110B to other components of a tool string that incorporates the articulable coupling 100. In some embodiments, articulable coupling 100 is permitted to freely articulate through the heel 16 of cased wellbore 10 as the articulable coupling 100 is transported therethrough, but also handle other deviations that may be present in the cased wellbore 10 (or other wellbores that differ in configuration from cased wellbore 10). Such free articulation permits articulable coupling 100 (along with the tool string along which it is positioned) to freely pass through difficult to navigate deviations formed in different wellbores, a valuable feature as faster drilling methods may not follow smooth and straight courses through the ground in the future. In some embodiments, the articulable coupling 100 may include a plurality of the flexible joints 105 spaced along a common longitudinal axis. Thus, articulable coupling may comprise an additional spider 112 coupled to an opposing end of connecting bar 101B that is, in turn, connected to a pair of yokes 110A and 110B of a third connecting bar.

Additionally, in this exemplary embodiment, an electrical signal pathway 107 extends through bars 101A, 101B and flexible joint 105 to provide electrical connectivity between bars 101A and 101B via the flexible joint 105. In this exemplary embodiment, portions of the electrical signal pathway 107 may be exposed to the surrounding environment. Additionally, in this exemplary embodiment, articulable coupling includes an electrical signal conductor (e.g., an insulated wire) 170 that passes along the electrical signal pathway including a hole formed in the spider 112 for carrying electric power and signals through the coupling 100. The electrical signal conductor 170 may be electrically insulated from the external environment (e.g., wellbore fluids) via a variety of insulating mechanisms such as an insulating coating, an insulating sleeve, and the like.

Figure 6:
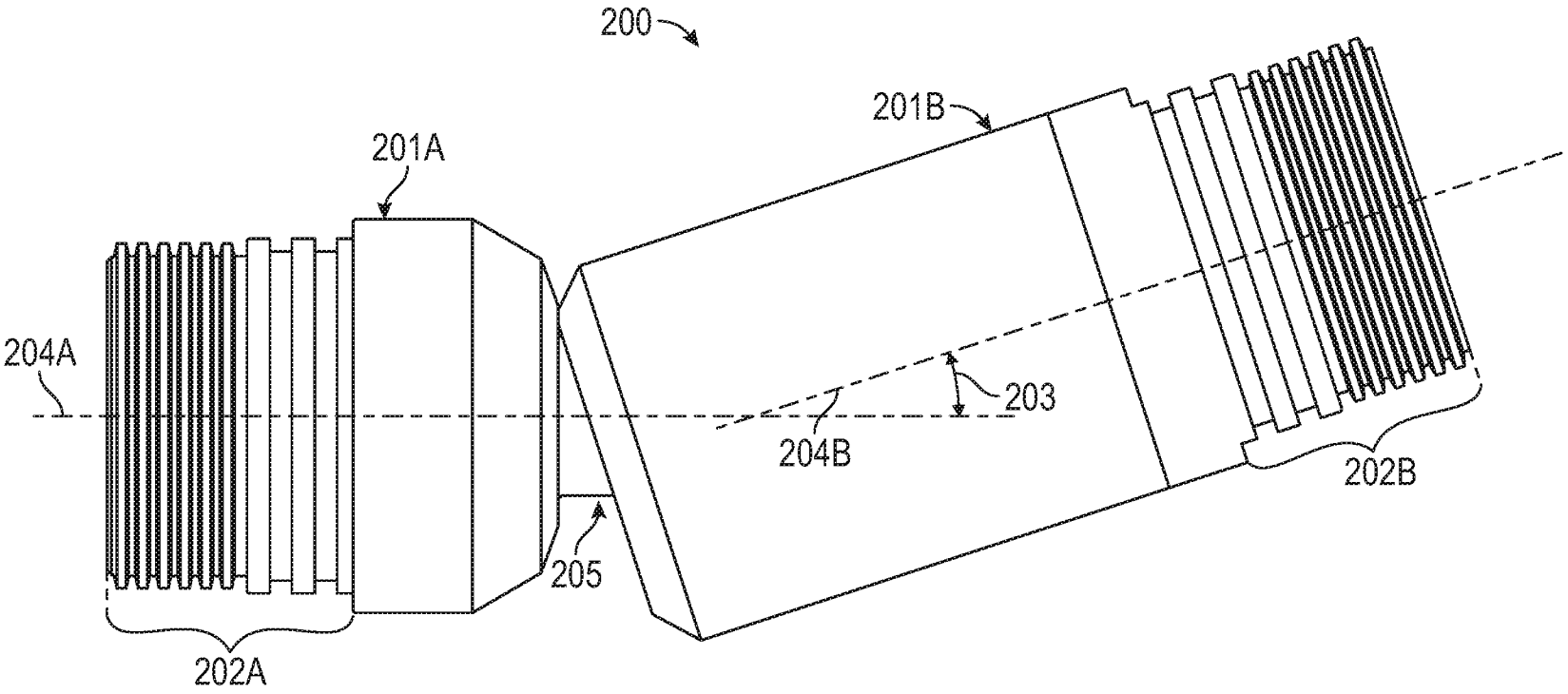
FIG. 6 is an elevation view of a second embodiment of an articulable coupling for connecting a pair of perforating tools and providing bend flexibility for a perforating tool string.

Turning now to FIG. 6, a second exemplary embodiment of a swivel or articulable coupling generally indicated by the arrow 200, comprises two primary components herein described as an alpha member or bar indicated by the arrow 201A and a bravo member or bar indicated by the arrow 201B that are connected together by a ball and socket type joint that defines a flexible joint 205 of the articulable coupling that permits bars 201A and 201B to articulate freely relative to each other. As used herein, the term "articulate freely" and "rotate freely" refer to articulation (e.g., pivoting) and rotation, respectively, between two members that is not encumbered by a wired connection extending therebetween which may be subject to damage from the articulation between the two members. Each bar 201A and 201B has a corresponding central or longitudinal axis 204A and 204B, respectively. For clarity in this embodiment, the socket is formed or machined within the body of the bravo bar 201B and all of the components of the bravo bar are identified in their reference with the letter "B" at the end. With the freedom of articulating movement enabled by the ball and socket type joint, the alpha bar 201A and bravo bar 201B pivot with respect to one another as shown at an exemplary angle 203. This pivoting or articulation facilitated by the ball and socket joint allows the bars 201A and 201B to freely assume a wide range of angles and orientation with respect to one another and, in addition, permits rotation of one bar rotating about its axis 204A, 204B independently of but with respect to the rotational position of the other. In this exemplary embodiment, bars 201A and 201B are permitted to freely pivot about three orthogonal axes (e.g., X, Y, and Z axes) relative to one another. In other embodiments, pivoting between bars 201A and 201B may be limited to a subset of the X, Y, and Z axes including only one of these three orthogonal axes. In some embodiments, angle 203 in this exemplary embodiment may, at its maximum, equal about 15 to about 30 degrees. However, the maximum magnitude of angle 203 may vary in other embodiments depending on the requirements of the given application. In this exemplary embodiment, the bars 201A and 201B may articulate or pivot with respect to one another in response to the application of external forces on the articulable coupling 200. In some embodiments, a perforating tool string may include one or more articulable couplings 200 spaced there along to enhance the flexibility of the tool string whereby the perforating tool string may endure most any radius of turn whether downhole or at the topside.

Figure 7:
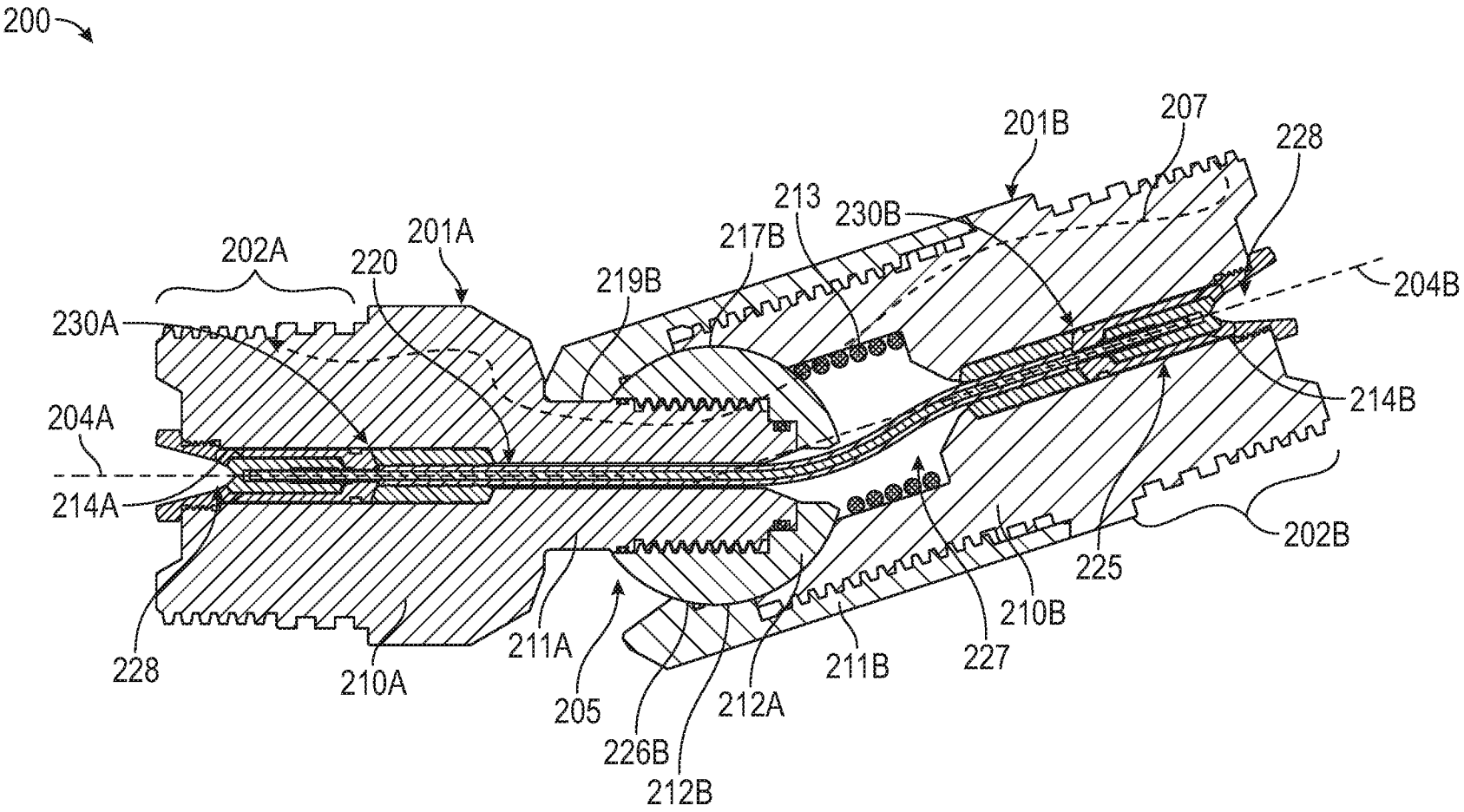
FIG. 7 is a cross-sectional view of the articulable coupling of FIG. 6 showing the internal structure that mechanically connects, seals, articulates and electrically connects adjacent tools in a perforating tool string.

Focusing on FIG. 7 and specifically on the alpha bar 201A, it includes a main body or alpha body 210A with a shaft 211A projecting from the alpha body 210A into the bravo bar 201B. Screwed onto the shaft 211A is a ball 212A which is the hub for bending or articulating for the articulable coupling 200. An alpha throughbore 214A extends through the alpha body 210A along the axis 204A from end to end to accommodate an electrical connection therethrough. The ball 212A and alpha body 210A are also electrically conductive forming the ground side of an electrical circuit through to perforating tools and other tools further down a downhole tool string. The body 210A includes a bolt thread and seal assembly 202A machined thereon for making a standard perforating tool connection.

In this exemplary embodiment, articulable coupling 200 includes an electrically conductive biasing member or ground spring (e.g., a coil spring) 213 positioned in the throughbore 214B and in electrical contact with both body 210B and ball 212A so as to maintain electrical connectivity therebetween. Particularly, the ends of ground spring 213 may be biased into physical contact with body 210B and ball 212A to maintain electrical connectivity therebetween even when articulable coupling 200 is subject to excessive vibration and other hazards present in the downhole environment. Additionally, the ground side may extend along an electrical ground pathway 207 that extends through bodies 210A, 210B, shaft 211A, ball 212A, and ground spring 213. In other embodiments, articulable coupling 200 may not include ground spring 213 and instead the ground path may extend only directly between body 210B and ball 212A rather than directly between body 210B and ball 212A and/or via ground spring 213.

Turning now to the bravo bar 201B, it too has a main body described herein as a bravo body 210B with an inside hemispherical face 217B arranged to be flush against the spherical exterior of the ball 212A at its left end and a conventional bolt thread and seal assembly 202B at the right end portion thereof. Closing around the ball 212A but clearly a part of the body 210B of bravo bar 201B is cover sleeve 211B connected by screw threads on the exterior of the bravo body 210B. The cover sleeve 211B includes a substantial through hole 212B large enough for the shaft 211A to pass through, but smaller than the diameter of the ball 212A. Additionally, cover sleeve 211B defines a frustoconical or tapered surface 219B extending from a terminal end thereof. Particularly tapered surface 219B tapers or reduces in inner diameter moving towards the ball 212A such that when angle 203 is at a maximum whereby tapered surface 219B contacts the neck 211A, the tapered surface 219B contacts the neck 211A along an elongate or linear interface rather than at a point to thereby minimize the stress imparted to the neck 211A and body 210B resulting from contact therebetween.

Similar to the alpha throughbore 214A, bravo body 210B includes a bravo throughbore 214B for accommodating an electrical signal pathway 225 that extends therethrough and through which electrical signals (e.g., carried by electrical signal conductors) may be transmitted between bars 201A and 201B via the flexible joint 205. Inside the cover sleeve 211B is a spherical portion that is also machined to be flush against the spherical exterior of the ball 212A. When securely threaded onto the bravo body 210B, the ball 212A is held firmly inside the bravo bar 201B at a high tolerance to minimize slack between the bravo and alpha bars 201A and B. As such, when axes 204A and 204B are coaxial or colinear, tension and compression between the bravo and alpha bars 201A and B are carried through the ball 212A in each direction but compression is carried on the bravo bar 201B by the bravo body 210B and tension through cover sleeve 211B. In this exemplary embodiment, the pattern for the respective bolt thread and seal assemblies 202A and 202B are the same or similar as on a conventional tandem sub 60 as shown at 62A and 62B in FIG. 4.

Recalling that the articulable coupling 200 may, in some instances, replace a conventional tandem sub 60 (shown in FIG. 4), articulable coupling 200 may also facilitate the transmission of electrical signals (e.g., electrical power, electrical data) through the articulable coupling 200 to the next tool in the tool string. In FIG. 4, a combination bulkhead and insulated conductive bar or member 65 pressure isolates the two perforating tools and also carries and passes electric signals and power between the two perforating tools A and B. In the articulable coupling 200 as shown in FIG. 7 and in more detail in FIG. 8, an electrical signal conductor or insulated wire 220 extends through the throughbores 214A and B and connects at each end to pressure bulkheads 230A and B.

Wire 220 includes a metal conductor 221 that is inside and protected by an electrical insulator 222. The electrical insulators (e.g., electrical insulator 222) described herein may comprise various electrically insulative materials including, for example, Nylon, polyether ether ketone (PEEK), and the like. Additionally, electrical insulator 222 (and other electrical insulators described herein) may take on various forms including as coatings, as heat-shrink materials, as flexible or rigid sleeves, and the like. In some embodiments, the electrical insulator 222 may be slit or clearance fit onto the metal conductor 221 while, in other embodiments, the electrical insulator 222 may be press-fit onto the metal conductor 221.

Pressure bulkhead 230B seals the internal space of the articulable coupling 200 at the throughbore 214B from the tool that connects to the articulable coupling 200 at the right, presumably a perforating tool such as 35 in FIGS. 1-4. The internal pressure of a perforating tool at depth in a well is preserved at about surface pressure. On the other hand, the internals of the articulable coupling 200, including most of the throughbore 214B, may be exposed to wellbore pressure which at depth would be at least several thousands or even tens of thousands of pounds per square inch (PSI). The first component of the pressure bulkhead 230B is a seal sleeve 231B (e.g., an elastomeric sleeve) that fits very snugly over the insulator 222. This seal sleeve 231B may include circumferential ridges on both the inside and the exterior thereof to seal against the bravo body 210B and against the insulator 222. In other embodiments, seal sleeve 231B may be smooth on the inside and/or exterior thereof.

In this exemplary embodiment, seal sleeve 231B is back supported at the right end by a nonconductive relatively rigid insulated tubular housing 233B for containing conductive terminal 235B inside. The tubular housing 233B electrically insulates the conductive terminal 235B from the electrically conductive alpha body 210B. Additionally, a spring contact 236B is positioned inside the conductive terminal 235B for receiving the bare end of the conductor 221 of wire 220 which may be stabbed therein maintaining continuous electrical conductivity even if the conductor 221 has to shift or move axially within the socket of the conductive terminal 235B as the articulable coupling 200 twists and flexes. Spring contact 236B comprises a plurality of circumferentially spaced collet fingers that are biased radially inwards and into contact with conductor 221. Spring contact may be sometimes referred to herein as circumferential spring contact 236B. Such spring contacts 236B may comprise, for example spring contacts and the like. The spring contact 236B may contact the conductor 221 at one or more points along its longitudinal length to provide parallel or redundant points of electrical contact between the conductor 221 and spring contact 236B, ensuring electrical connectivity is maintained therebetween even when subjected to vibration, impact, and other disturbances during downhole operation.

Moreover, the conductor 221 may rotate freely (e.g., about a longitudinal axis thereof) inside the spring contact 236B while continuous electrical connection is maintained and, in addition, the spring contact 236B may rotate within conductive terminal 235B while maintaining continuous electrical connection. Thus, conductor 221 may move axially relative, rotativity (e.g., about the longitudinal axis of conductor 221), and (to a limited degree) pivotably (e.g., about an axis at an angle to the longitudinal axis of conductor 221) relative to spring contact 236B. In this arrangement, if alpha bar 201A is rotating around its axis 204A relative to bravo bar 201B, the wire 220 is free to slip and not get bound up during assembly and operation of the articulable coupling 200. Instead, conductor 221 may rotate freely within spring contact 236B to prevent damaging of the conductor 221 while maintaining electrical connectivity therebetween. Conductive terminal 235B is kept within the insulated tubular housing 233B by a ring cap 234B which itself is held in place by the steel retainer 215B that is threaded into the end opening of the throughbore 214B in bravo body 210B. In other embodiments, tubular housing 233B and ring cap 234B may comprise a single, unitary or monolithically formed member with conductive terminal 235B being press fit or tubular housing 233B/ring cap 234B being overmolded onto the conductive terminal 235B. The pressure bulkhead 230B is thereby captured within the throughbore 214B between shoulder 216B and retainer 215B. In some embodiments, due to providing a seal between its respective outer and inner diameters, hydraulic pressure applied to seal sleeve 231B may be transferred to tubular housing 233B and ring cap 234B such that no significant tensile forces are applied to conductor 221.

Figure 8:
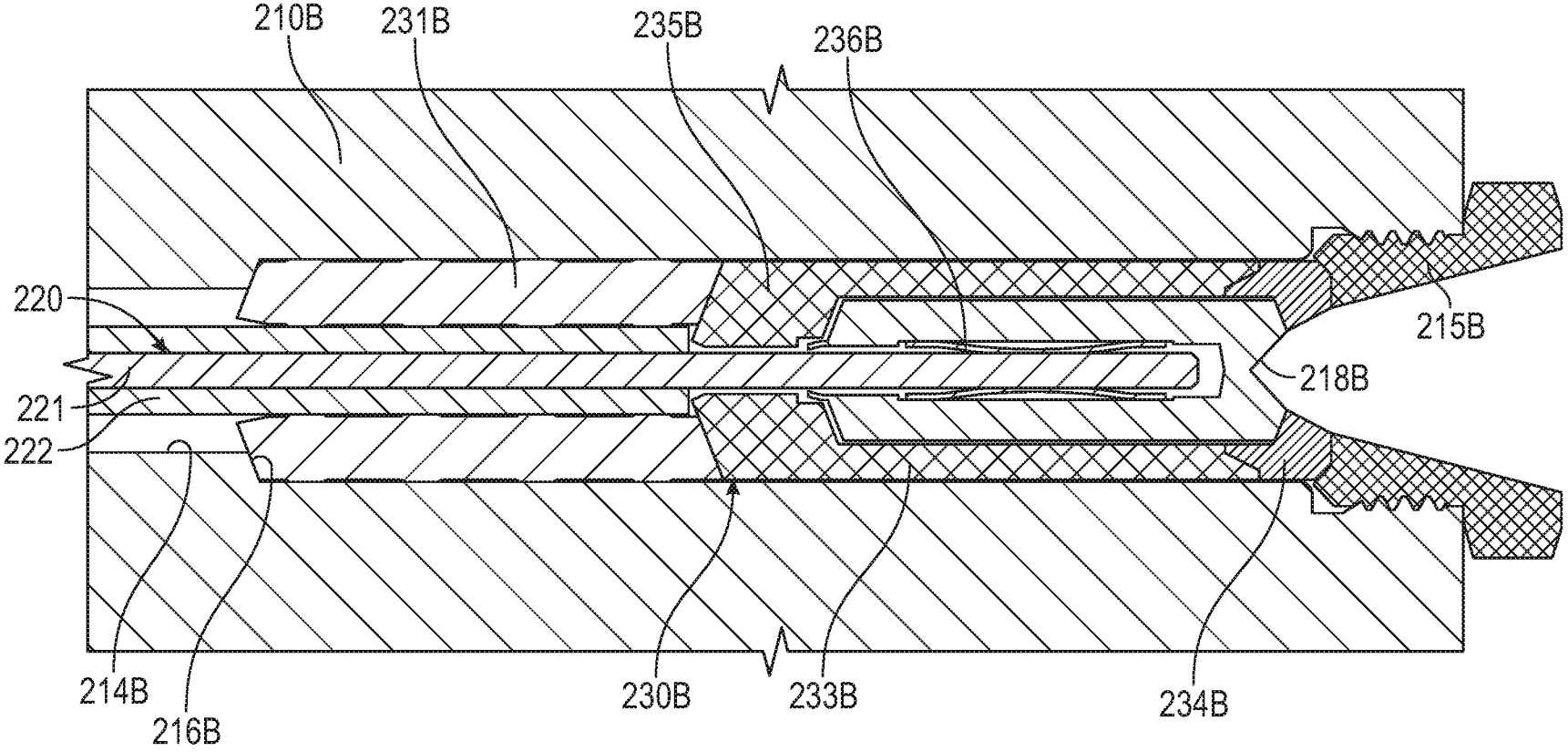
FIG. 8 is an enlarged cross-sectional view of the seal and electrical connection for the articulable coupling of FIG. 6.

Still focusing on FIG. 8, it is noted that the articulable coupling 200 physically connects to an adjacent tool such as a perforating tool 35 by bolt thread and seal assembly 202B. Additionally, articulable coupling 200 provides a pair of electrical connections that extend through the electrical signal pathway 225 and the electrical ground pathway 207. The electrical signal pathway 225 (through which a "signal side" of the electrical circuit is provided) extends generally along the core or axis to the articulable coupling 200 with conductor 221, spring contact 236B, and the conductive terminal 235B each being positioned along the electrical signal pathway 22. The end of the conductive terminal 235B includes open conical socket 218B. Via this open conical socket electricity and signals are passed to the adjacent tool by a pointed conductive contact or probe (typically brass) that is often spring loaded and pressed into open conical socket 218B. A similar arrangement may be included at the alpha end of the articulable coupling 200.

The electrical signal pathway 225 is electrically insulated from the electrical signal pathway 207. In this exemplary embodiment, the electrical signal pathway 225 extending across pivotable joint 205 and between bars 201A and 201B includes both a pressure exposed zone 227 and a pair of pressure isolated zones 228 with the pressure exposed zone 227 being located between the pressure isolated zones 228. Particularly, the pressure exposed zone 227 of electrical signal pathway 225 extends between the pair of pressure bulkheads 230A and 230B while a first pressure isolated zone 228 extends from pressure bulkhead 230A to the left of FIG. 7 while a second pressure isolated zone 228 extends from pressure bulkheads 230B to the right of FIG. 7 such that there is no overlap along electrical signal pathway 225 between any of the zones 227 and 228. In this exemplary embodiment, the pressure exposed zone 227 of electrical signal pathway 225 is exposed to fluid pressure in the external environment such as the wellbore pressure while the pressure isolated zones 228 are both isolated from pressure in the external environment. Additionally, the pressure isolated zone 228 to the left in FIG. 7 is isolated from pressure in the pressure isolated zone 228 to the right in FIG. 7.

In one advantageous aspect of the present disclosure is bending flexibility for the insulated wire 220 to permit repeated bending and straightening of the tandem sub along with any rotation of the bravo bar and alpha bar. This includes bending in any direction and shifting direction of bending in any direction. The arrangement for this aspect of bending flexibility begins with insulated wire 220 comprising spring steel sometimes called a piano wire or music wire for its robustness and spring tempering. While this particular insulated wire permits bending, it retains considerable resistance to deforming compared to conventional insulated copper wire. The insulated wire may also comprise, in other embodiments, spring tempers of various stainless steel alloys or nickel-based alloys.

An annular wiper may optionally provided between ball 212A and cover sleeve 211B to keep debris out of the interface between the two where only a few thousands of an inch separate the periphery of the ball 212A and the inside spherical shape created within the bravo bar 201B and the cover sleeve 211B. For instance, the wiper could be positioned along an annular shoulder or notch 226B formed along the inner surface of cover sleeve 211B. The wiper could comprise various materials (e.g., elastomeric, thermoplastic and other polymeric materials) and may have various cross-sectional geometries (e.g., an O-ring, a T-ring, a D-ring, and the like). Debris such as sand or grit in this small place could cause excessive wear for a component of a perforating tool string that is intended to be used over and over for many perforating operations. Additionally, debris could interfere with the electrical connection provided by pressure bulkheads 230A and 230B.

Figure 9:
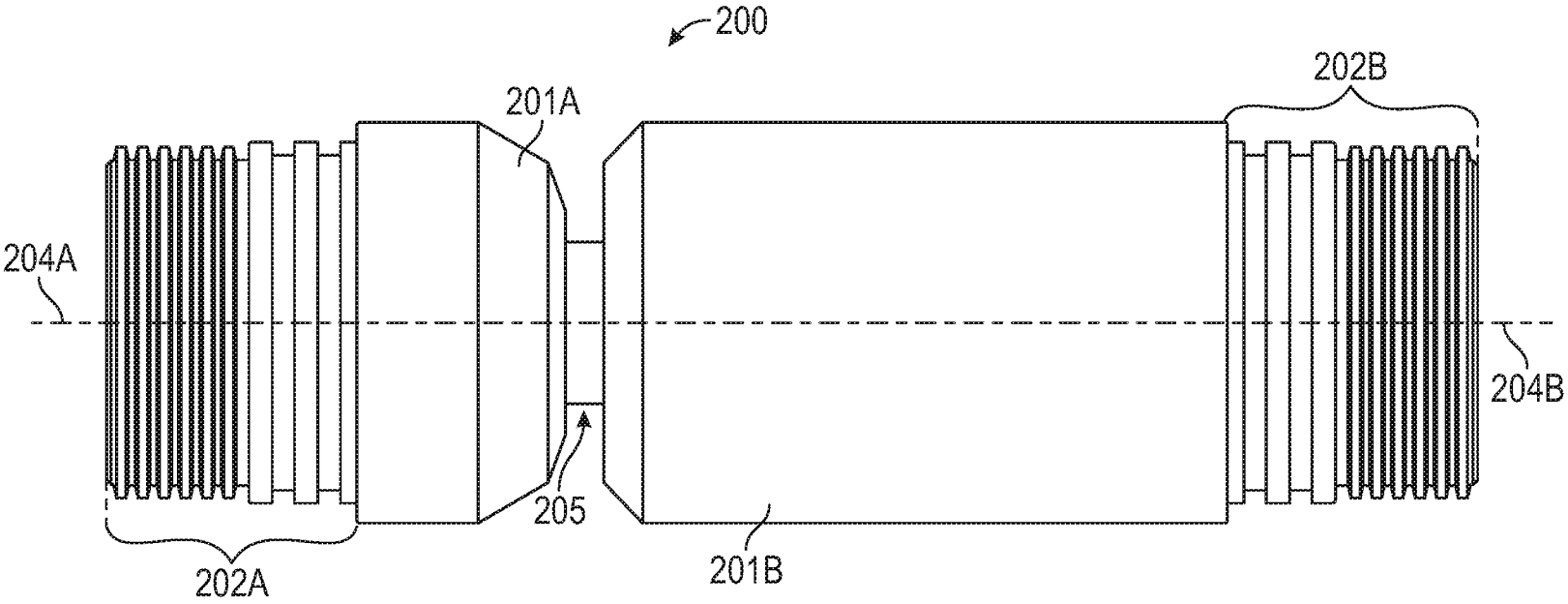
FIG. 9 is an elevation view showing the articulable coupling of FIG. 6 in its linear straight arrangement.

Turning briefly to FIG. 9, the articulable coupling arrangement 200 is shown laying straight with axes 204A and 204B being colinear. This straight configuration is very likely to be the condition it will take for assembly into a perforating tool string and for much of its operational time.

Figure 10:
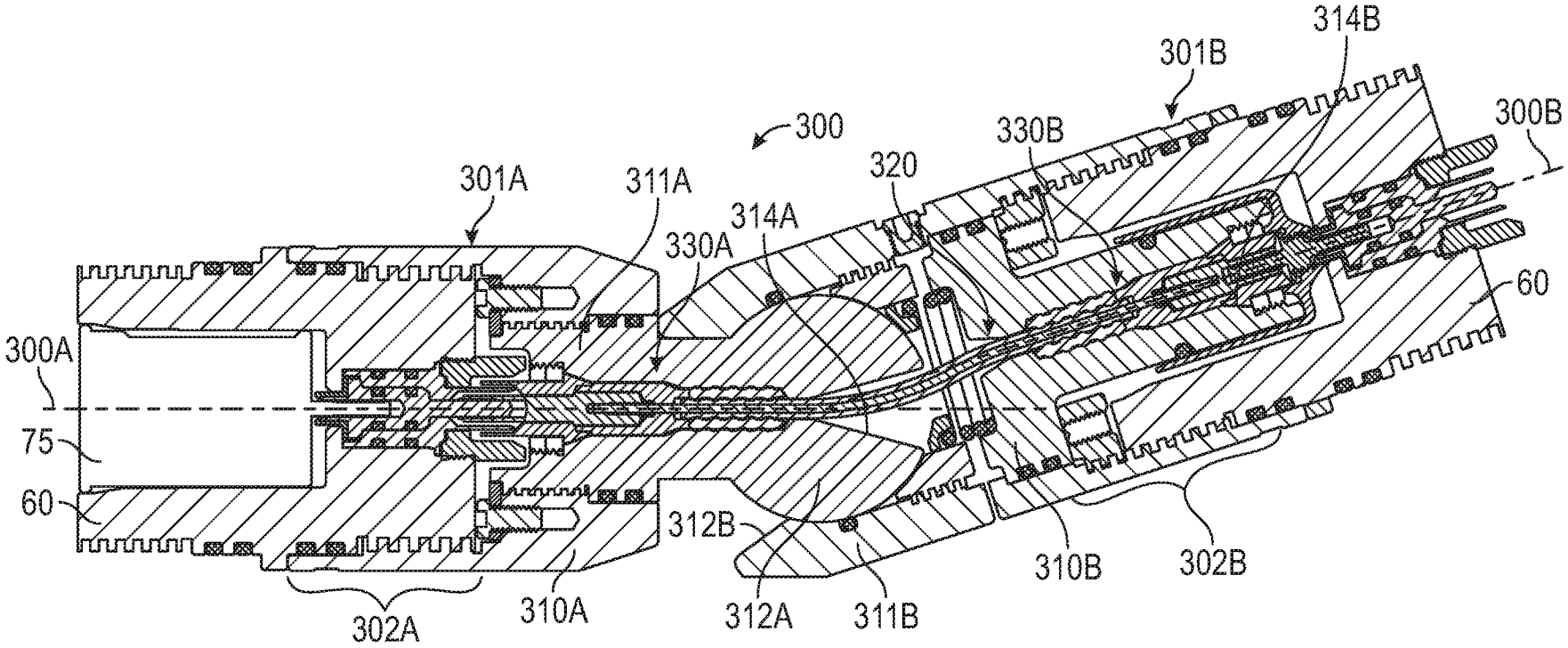
FIG. 10 is a cross-sectional view of a third articulable coupling arrangement to provide bend flexing about a ball and socket joint for use in a hydrocarbon seeking perforating tool string in an angular configuration.

Turning now to FIG. 10, a slightly different arrangement for a swivel or articulable coupling is indicated by arrow 300. In this configuration, two principle features are shown. In this exemplary embodiment, the ball 312A is integral or monolithically formed with shaft 311A. Secondly, the end couplings of the articulated coupling 300 are box threads suited for connection to a standard tandem sub 60. One benefit of including a tandem sub is that it is expected that a perforating tool will be positioned on either end of the articulated coupling 300 and an operator is expecting and hoping to re-use the device for maybe a dozen or more different perforating tool strings. However, the impulses passing in all directions from detonation of the shaped charges inside the perforating tools can be profound. To insulate the articulable coupling 300 with a heavy tandem sub 60 may extend the service life of such articulable couplings. Additionally, insulating articulable coupling 300 with tandem sub 60 may also minimize the need for redressing internal components of articulable coupling 300 such as, for example, internal components of pressure bulkhead 330B which would otherwise receive the blast generated by the activation of a perforating tool located adjacent to the articulable coupling 300. Minimizing the need to redress internal components of articulable coupling 300 may reduce the amount of time required to prepare articulable coupling 300 between different deployments into cased wellbore 10, for instance.

In this exemplary embodiment, the electrical connection to the perforating tools is different top and bottom where a control pod 75 rests inside the left side tandem sub 60 connected to the articulated coupling through a proprietary connection arrangement. In this exemplary embodiment, the control pod 75 may control the perforating tool that connects to the left tandem sub 60 while the perforating tool that connects to the tandem sub 60 at the right of FIG. 10 connects directly to the articulable coupling 300. The control pod for controlling the perforating gun to the right in FIG. 10 of articulable coupling 300 may be positioned at the distal end of that perforating tool. The ground side of the electrical circuit (e.g., extending through or along electrical ground passageway similar to electrical ground passageway 207 shown in FIG. 7) includes the steel bravo and alpha bodies 310A and 310B and their components which are insulated from the signal side conductors. Similar components in the embodiment of FIG. 10 to components of other described embodiments use similar reference numbers in a 300 series.

Figure 11:
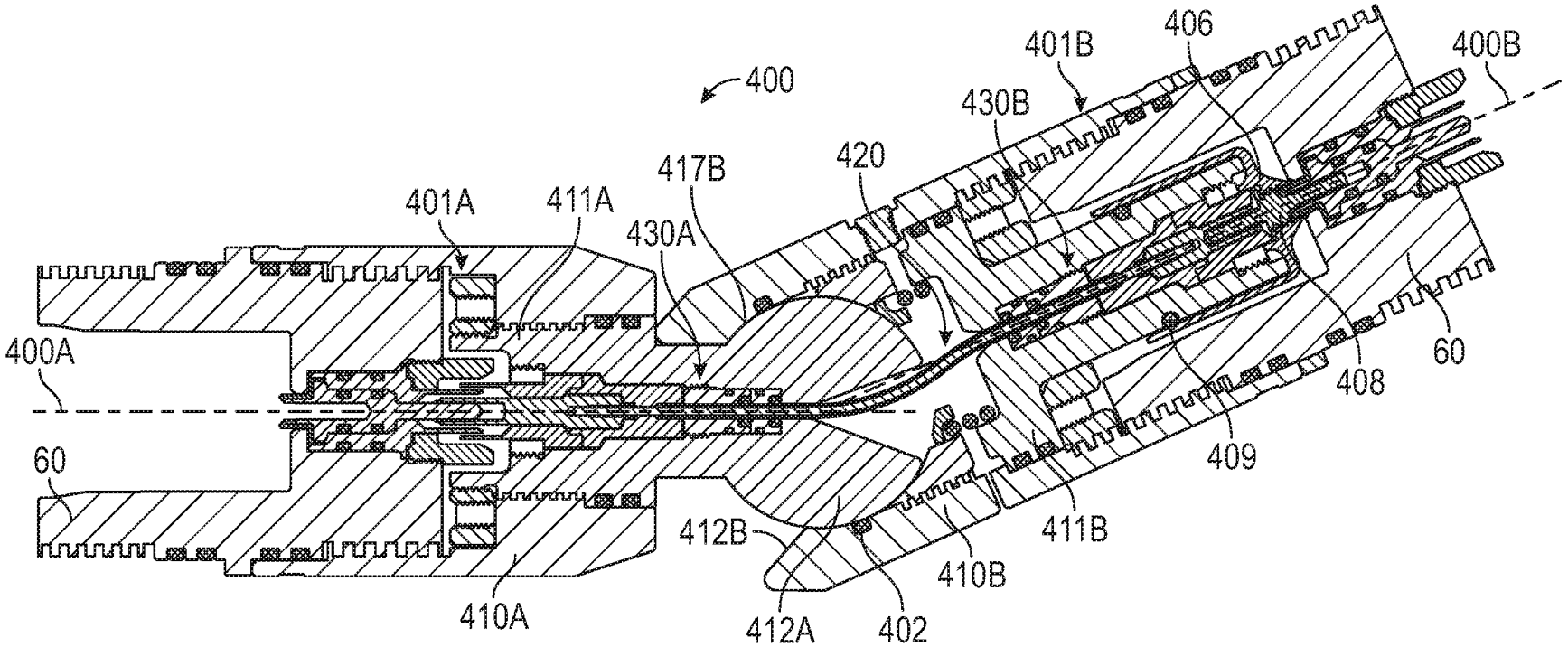
FIG. 11 is a cross-sectional view of a fourth articulable coupling arrangement somewhat similar to FIG. 10.

And that leads to the next embodiment in FIG. 11 indicated by the arrow 400. It is similar to the embodiment of FIG. 10 however, for instance, the seals around the electrical wire 420 are different. The internal spaces of all of the articulable couplings are exposed to well pressure inside and out so that friction between the ball and the socket does not become excessive making articulation very resistant. At the same time, the perforating tools are generally required to keep their internal void spaces filled with air that is at about surface pressure to minimize destruction of components (and/or electrical shorting) of the perforating tool whereby the perforating tool after detonation has sufficient structural integrity to be pulled out of the wellbore by the wireline. For example, if the interior spaces were filled with an incompressible fluid such as water or well fluids, the perforating tool is vulnerable to bursting where having an air pocket inside operates like a natural shock absorber without altering or depowering the directed energy blast. So, the pressure bulkheads 430A and B hold high pressure.

In this exemplary embodiment, articulable coupling 400 includes an annular seal 402 in the form of an O-ring that is positioned along hemispherical face 417B so that the groove that receives the seal 402 does not jeopardize the strength of the body 410B while sealing the interface between the ball 412A and the hemispherical face 417B. Additionally, in this exemplary embodiment, articulable coupling 400 includes an annular protective hub 406 and a solid electrical connector 408 that is coupled to and received within the protective hub 406. Particularly, electrical connector 408 includes an opposing pair of electrical pin contacts for electrically connecting pressure bulkhead 430B with the tandem sub 60 coupled therewith. The protective hub 406 axially conveniently slides over and onto a terminal end of cover sleeve 411B and is held in position on cover sleeve 411B via an annular seal or elastomeric member (e.g., an O-ring seal) 409 that is positioned radially between the protective hub 406 and cover sleeve 411B. Given that the electrical connector 408 projects outwardly from body 410B, electrical connector 408 is susceptible to damage during assembly of the tubular string comprising articulable coupling 400. Given that protective hub 406 conveniently slides over cover sleeve 411B, protective hub 406 and electrical connector 408 may be conveniently replaced if such damage were to occur thereto.

Figure 12:
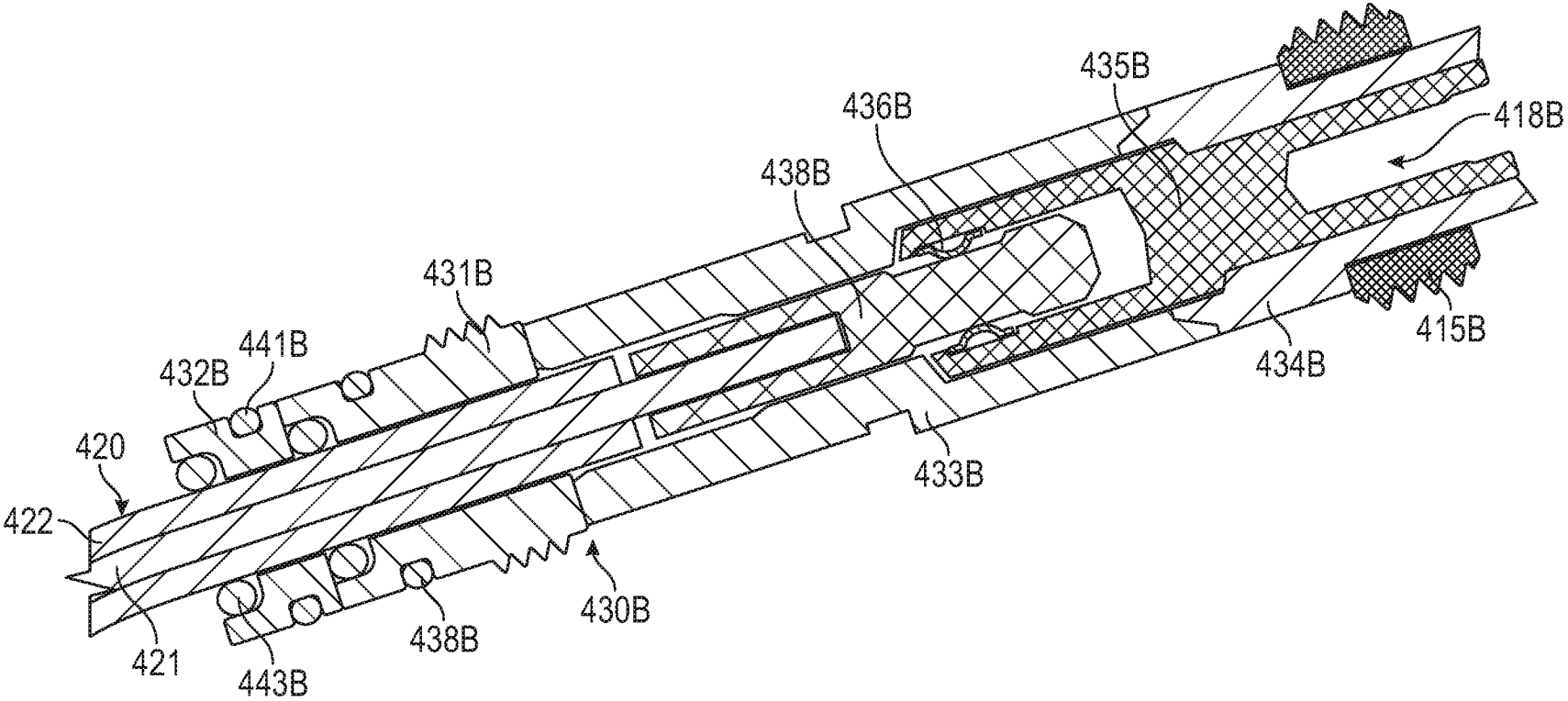
FIG. 12 is an enlarged-cross sectional view of the seal and electrical connection for the fourth arrangement shown in FIG. 11.

Turning to FIG. 12, there are a few differences from the embodiment shown in FIG. 8. In this exemplary embodiment, wire 420 includes a terminal connector 438B attached to the conductor 421 at the end just beyond the insulation 422. For example, terminal connector 438B may be crimped, welded (e.g., spot welded), and the like to conductor 421. Conductive terminal 435B includes a spring like collar 436B that is spring biased toward the periphery of the terminal connector 438B maintaining continuous electrical connection but again allowing some axial translation or movement along with rotational movement between the connector 438B and collar 436B to avoid putting much twist on the wire 420. While a stiff but spring tempered wire may be preferred in some applications, most any wire may be used including solid-core or stranded wire with an associated connector (e.g., a crimped connector). And the insulation 422 may be adhered to the conductor or be tubular with the conductor 421 inserted into the insulator 422. Also, in this exemplary embodiment, conductive insulator 435B includes a socket 418B for a pin connector with spring contacts (not shown) on the outside to be inserted for electrical connection.

For sealing against pressure differential, the FIG. 12 arrangement includes annular seal collars 431B and 432B that include grooves or other shapes to hold annular seals (e.g., O-rings, T-rings, D-rings, and the like) against the insulator 422 and the inside of the throughbore. A tubular housing 433B is provided to insulate (along with ring cap 434B) the terminal connector 438B and the conductive terminal 435B from grounding against the grounded steel components. Pressure bulkhead 430B also includes screw threads on seal collar 431B and the threaded retainer 415B to remain fixed in place. Additionally, an annular outer seal 441B is positioned along an outer surface of 432B while an annular inner seal 443B is positioned along an inner surface thereof and in contact with the wire 420. In some embodiments, the amount of radially inner compression or squeeze applied by inner seal 443B may be tuned to control the amount of rotation inner seal 443B undergoes in response to rotation of wire 420 (e.g., whether relative rotation is permitted between inner seal 443B and wire 420 is permitted or restricted) to minimize wear to the inner seal 443B.

Figure 13:
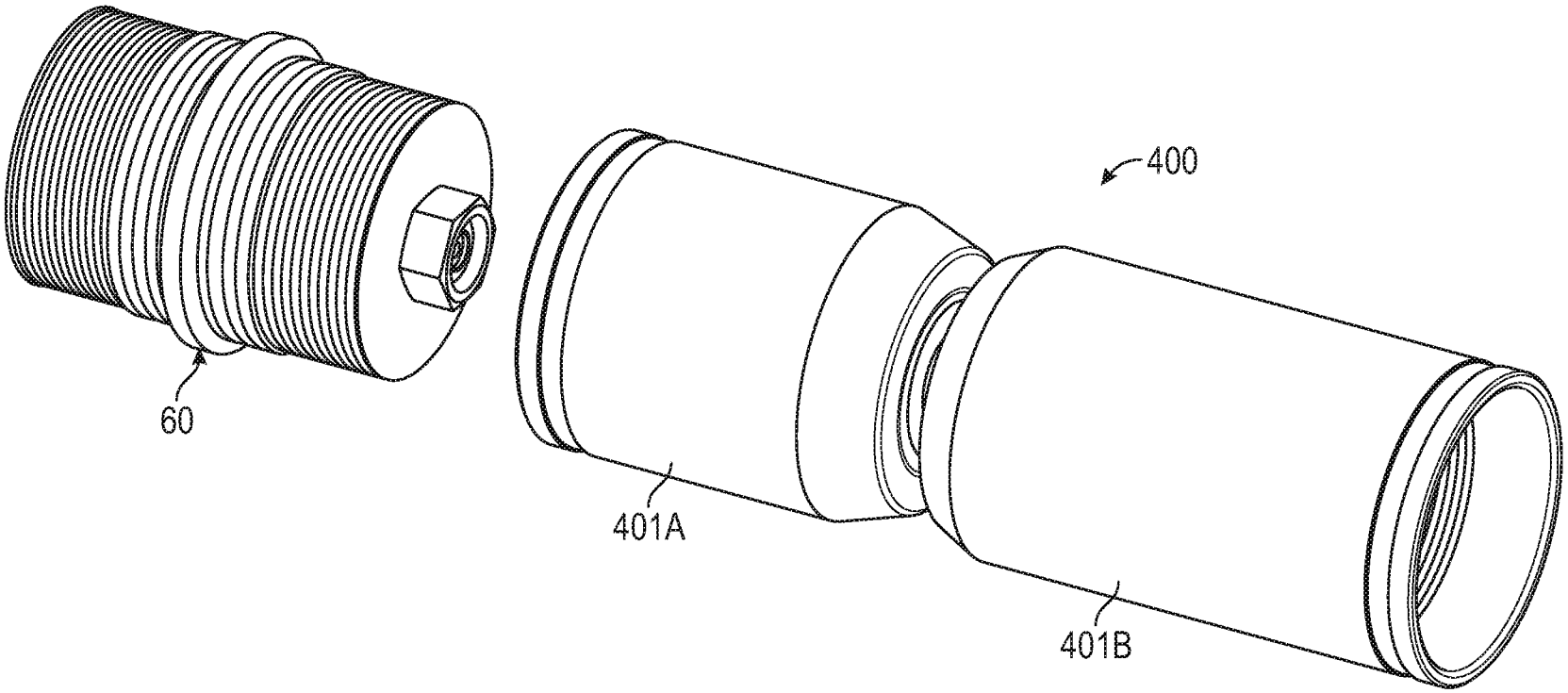
FIG. 13 is a perspective view of the fourth articulable coupling arrangement lined up for attachment with a conventional tandem sub.
Figure 14:
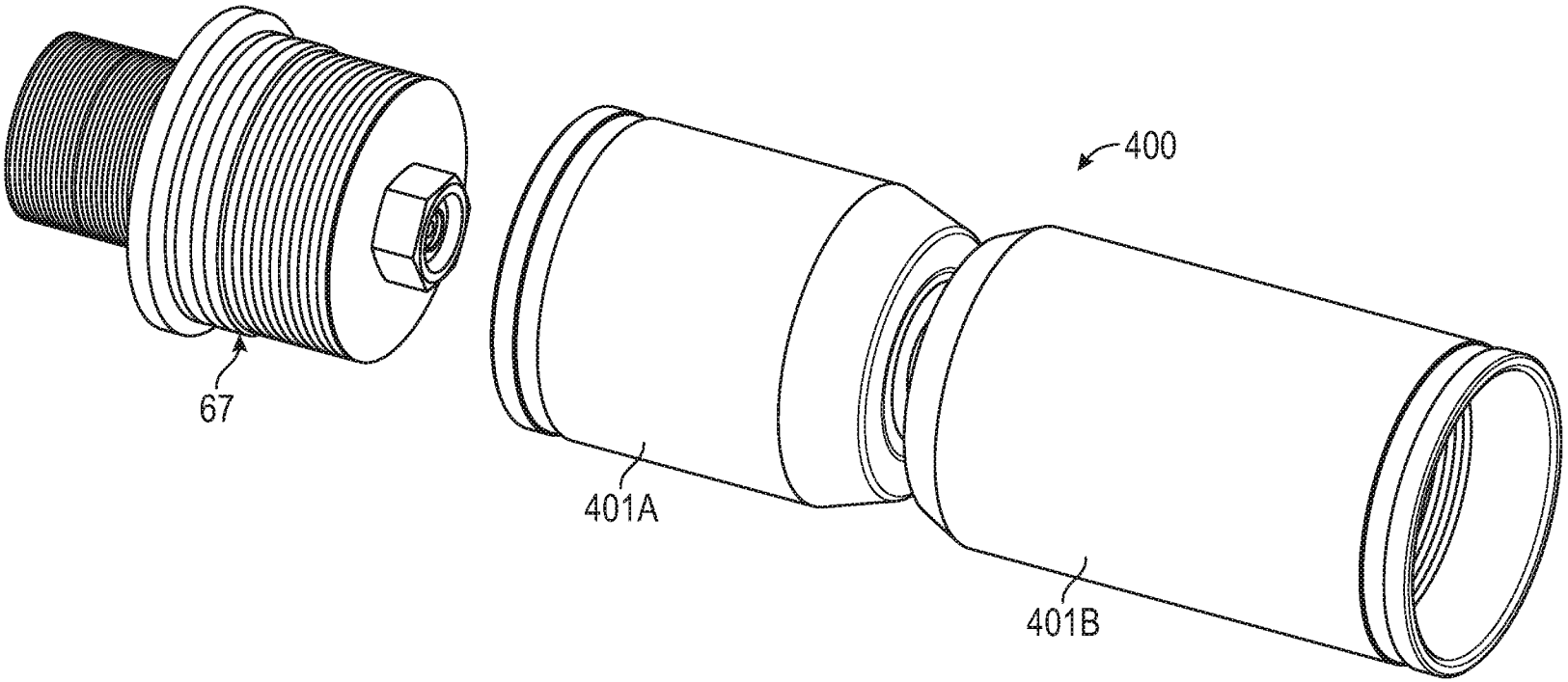
FIG. 14 is a perspective view similar to FIG. 13 but with the fourth articulable coupling lined up for attachment to a tandem sub having perforating tool threads on the end connecting to the coupling but smaller patterned threads on the opposite end for attachment to a different thread patterned downhole tool.

Articulated couplings described herein do not only connect perforating tools but also connect a tandem sub with the appropriate thread and connector designs can be installed on the box thread ends such as shown in FIGS. 13 and 14. In FIG. 13, a common tandem sub 60 is shown for attachment to the alpha bar 401A whereas a tandem sub 67 in FIG. 14 is shown with two different thread patterns for connecting to a non-perforating tool.

Figure 15:
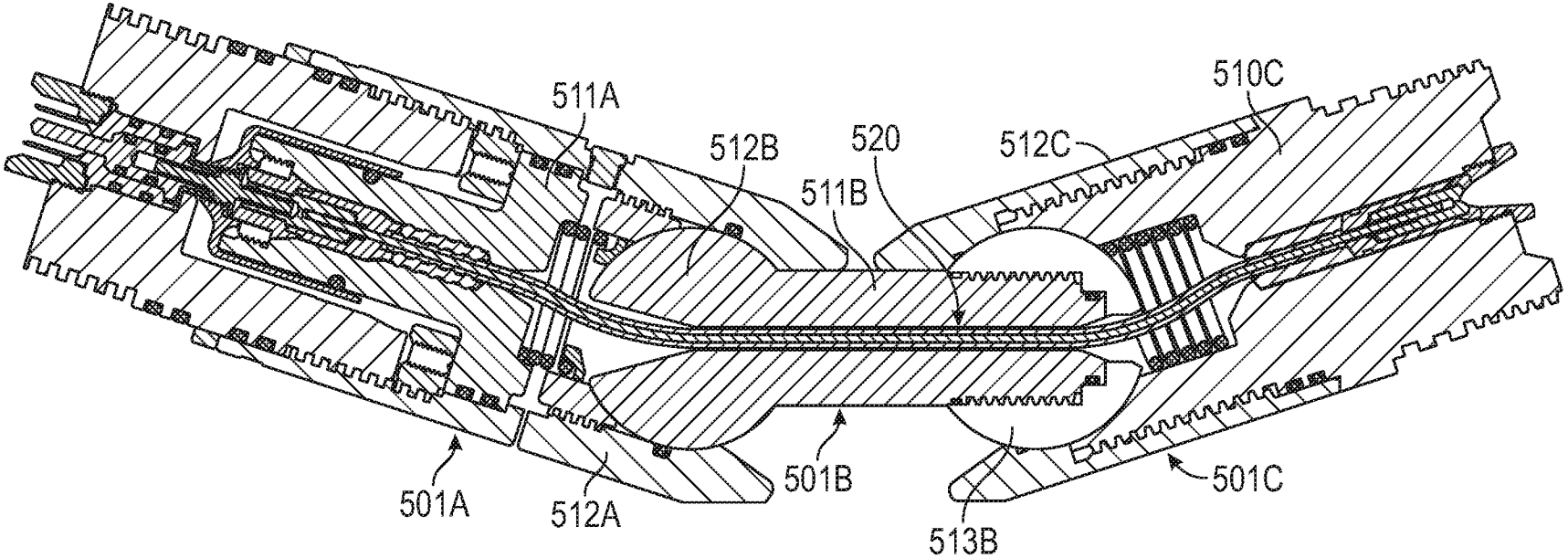
FIG. 15 is a cross-sectional view of double ball and socket articulable coupling that may provide greater articulation angle.

Turning to FIG. 15, a further alternative swivel or articulable coupling design is indicated by arrow 500. While the ball and socket design is preferred for its strength and durability both in axial compression and tension, it is conceivable that higher articulation demands may not be achievable and also preserve reserve strength in tension. Creating an articulable coupling having a pair of ball and socket joints could provide the additional articulation necessary. If really large bends or tight radius bends are needed, using principles present here, a three, four or five ball coupling may be assembled. In FIG. 15, the component members or bars are identified left to right as alpha, bravo and charlie where the bravo bar 501B includes a double ended ball like a dog bone. The bravo bar includes an integral ball and a threaded on ball to allow the cover sleeves 512A and 512C to be assembled to the bravo bar 501B. The wire 520 is longer but still sealed at the end bars (A and C).

Figure 16:
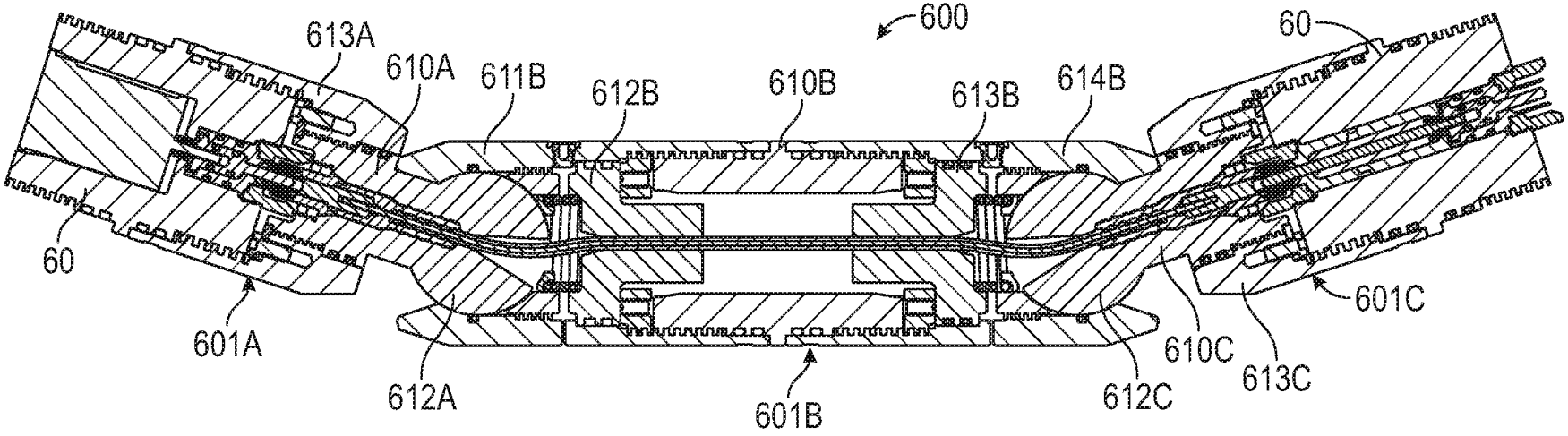
FIG. 16 is a cross-sectional view of a second double ball and socket articulable coupling arrangement that is similar to the alternative arrangement shown in FIG. 15.

Turning to FIG. 16, a second arrangement of a double socket jointed articulable coupling is indicated by the arrow 600. In this exemplary embodiment, the two balls are part of the end bars (A and C) with the sockets formed within the bravo bar 601B. Again, this double socket gains greater range of motion or tighter radius bending. The alpha bar 601A includes an alpha body 610A with a ball 612A integrally incorporated with the body and a cover member or bar 613A that includes the box threads from coupling to the tandem sub 60. The cover bar 613A is securely attached to the alpha body 610A. The bravo bar 601B includes a bravo body 610B, socket bars 612B and 613B and cover sleeves 611B and 614B. Charlie member or bar 601C is similar to alpha bar 601A with a ball 612C, a charlie body 610C and a cover sleeve 613C.

Figure 17:
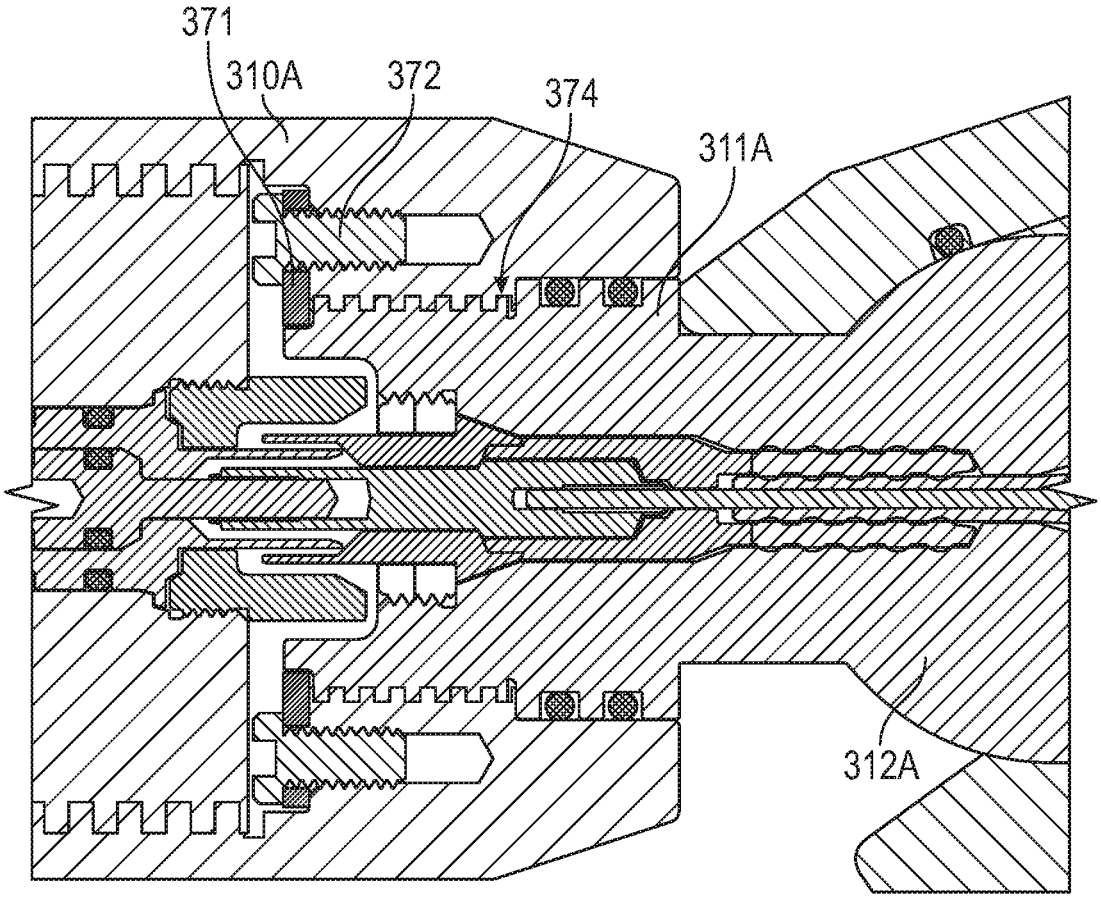
FIG. 17 is an enlarged fragmentary view of an articulated coupling for illustrating an aspect of the present disclosure for securing that threaded components remain tightened together providing extra security against loosening while in use.
Figure 18:
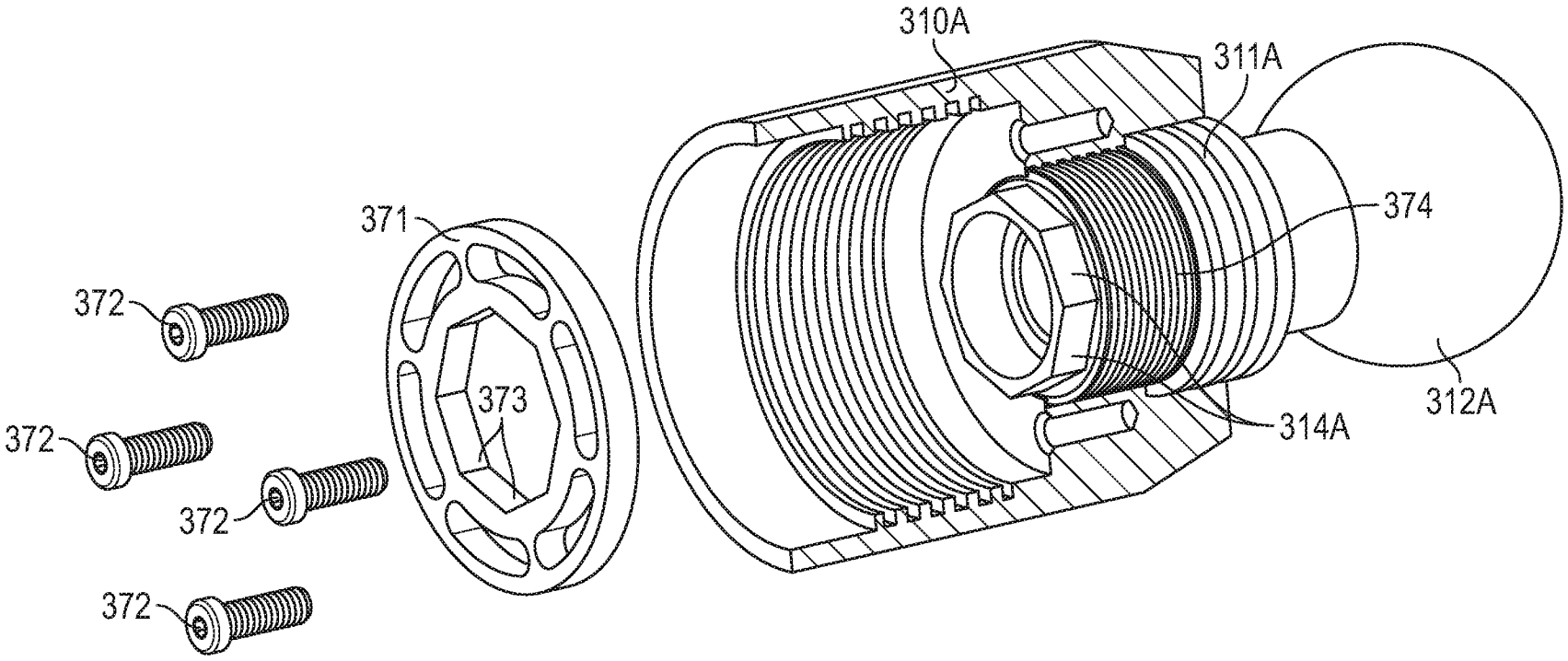
FIG. 18 is a fragmentary perspective view of the articulated coupling of FIG. 17.

Focusing particularly on the mechanisms used in this exemplary embodiment to provide extra assurance that threads on critical components do not back off, FIGS. 17 and 18 show alpha body 310A and alpha shaft 311A from an earlier embodiment but quite enlarged. A plate 371 is designed with machine flats 373 like a hex pattern or star shape that engages with corresponding flats 314A formed on the left end of shaft 311A. Once the threads 374 are set and torqued, plate 371 is attached and nested with the features that prevents alpha shaft 211A from rotating relative to plate 371, screws 372 are attached to provide extra security that threads 374 will not back off.

Figure 19:
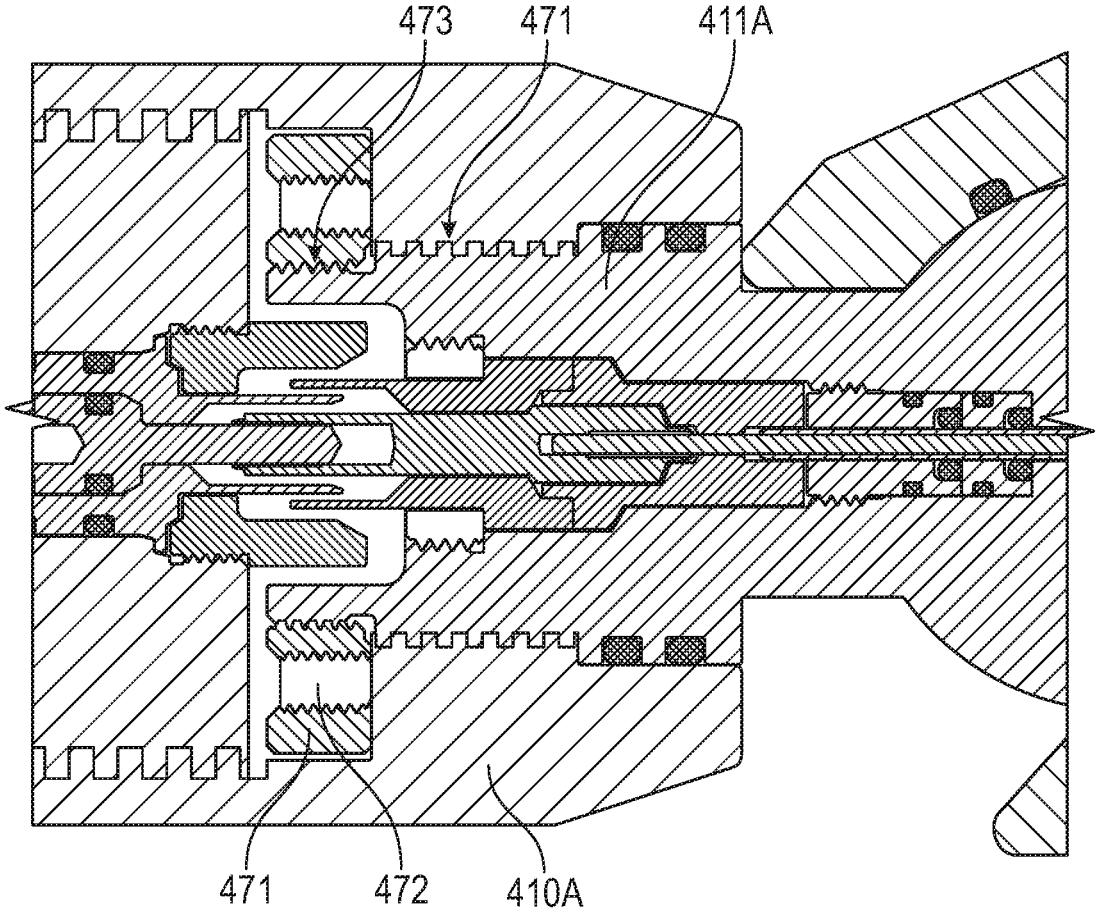
FIG. 19 is an enlarged fragmentary view of an articulated coupling similar to FIGS. 17 and 18 illustrating a different arrangement for securing that threaded components remain tightened together providing extra security against loosening while in use.

In FIG. 19, a different arrangement is shown that serves a similar function as the arrangement shown in FIGS. 17 and 18. In this exemplary embodiment, a threaded ring 471 is screwed onto alpha shaft 411A at threads 473 after alpha body and alpha shaft are fully tightened together. However, threads 473 are reverse threaded. Set screws 472 are tightened to bind the ring 471 but if the shaft 411A were to start to unwind from the body 410A, it would further tighten the threads 473 on the ring 471.

Figure 20:
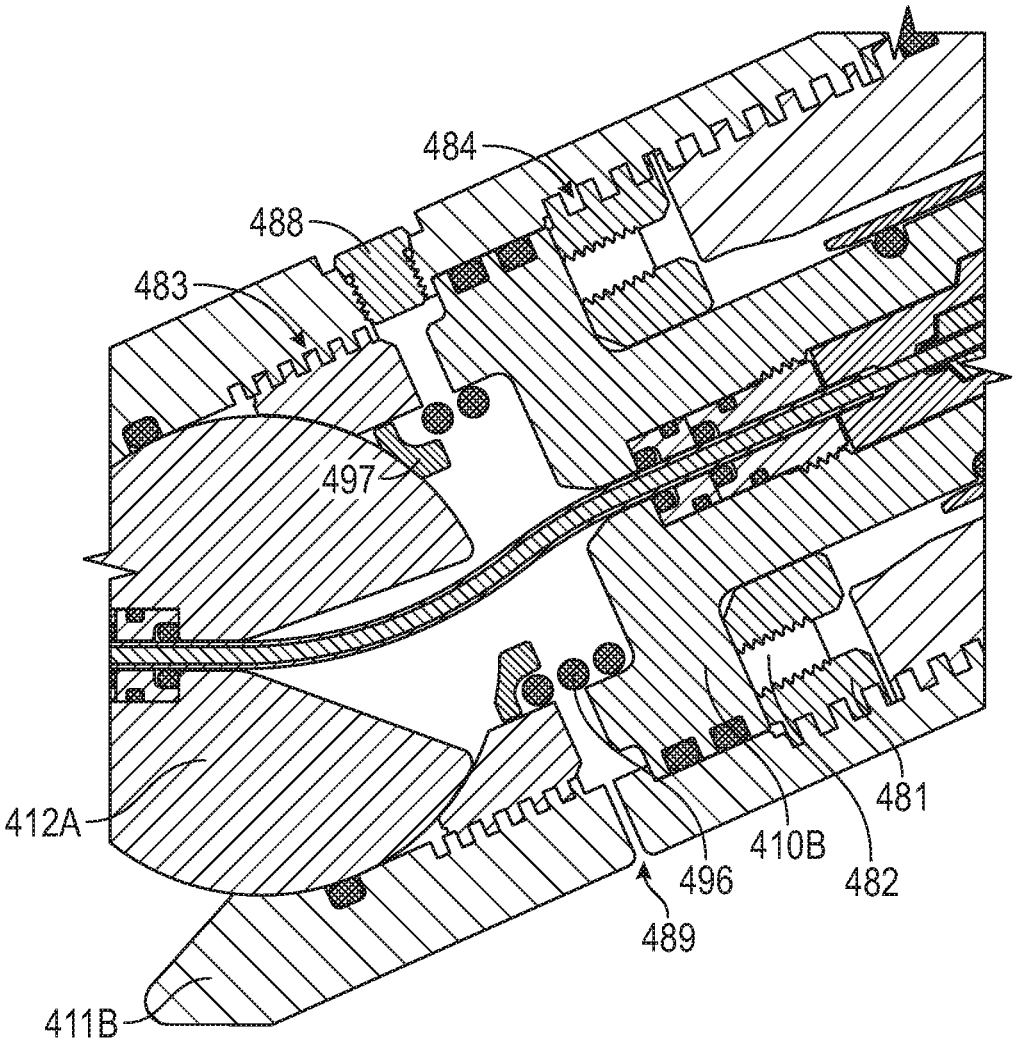
FIG. 20 is an enlarged fragmentary view of an articulated coupling similar to FIGS. 17-19 illustrating a second different arrangement for securing that threaded components remain tightened together providing extra security against loosening while in use.

A similar arrangement is shown in FIG. 20 but on the socket side of the ball and socket arrangement. In this exemplary embodiment, bravo body 410B is attached to cover sleeve 411B at threads 483. In some embodiments, threads 483 comprise left-handed threads. Once torqued down, a threaded ring 481 is screwed down on threads 484 against bravo body 410B. In some embodiments, threads 484 may be oppositely threaded (e.g., comprise right-handed threads) from threads 483. Set screws 482 are torqued down to increase the friction of the threads 484 to let threaded ring 481 back off and bravo body and bravo cover sleeve from loosening from one another. In another aspect of the disclosure that is well displayed in FIG. 20 is the port for adding highly viscous grease or sealant to fill all of the void spaces inside the articulable couplings which may be injected or otherwise provided via a radial port that is enclosed during operation by a plug (e.g., a threaded plug) 488. For example, while the plug 488 is replaced, a weep hole 489 formed in cover sleeve 411B reveals that the internal spaces are filled with the high viscosity grease (along, potentially, with a lower viscosity lubricant for lubricating the ball and socket) and also keep inside pressure in common with outside pressure. A primary purpose of the highly viscous grease is to resist the introduction of debris or grit into the inside of the articulable coupling which could otherwise result wear or abrasion on critical surfaces such as the ball exterior or socket interior and thereby induce early failure (e.g., mechanical failure, electrical discontinuities, and the like) of the articulable coupling.

In another aspect of the present disclosure, continuity of the circuit along the ground side path is important as well. To assure continuity across the ball to socket connection, spring 496 biases spring seat 497 to follow in continuous contact with the ball while also being in continuous contact with the bravo body 410A.

Figure 21:
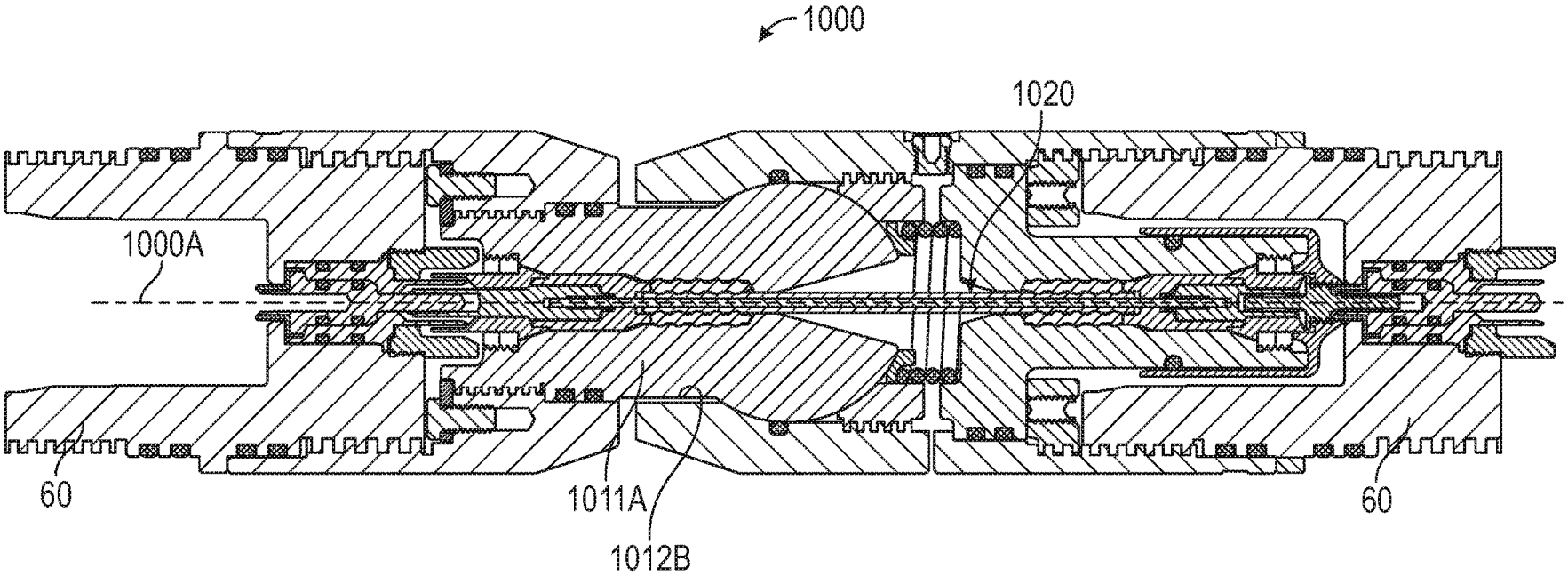
FIG. 21 is a cross-sectional view of a swivel coupling that is similar to prior articulable coupling arrangements in FIGS. 6-20 but has limited bend flexibility while allows unlimited relative rotation between the coupled ends.

Noting that the articulable coupling designs allow infinite rotation, a swivel coupling indicated by the arrow 1000 is shown in FIG. 21. This is very similar to the articulable coupling design in FIG. 10, but redesigned to articulate no more than a few degrees. The alpha shaft 1011A has a larger diameter while the opening 1012B has a smaller diameter to fit down over the shaft 1011A. This swivel coupling 1000 is useful for tool strings that experience substantial torsion from the wireline cable or moving through the borehole and resisting rotation is less preferable than accommodating it. The wire 1020 is connected at the ends as shown in FIG. 8 or 12 to allow for infinite rotation.

Figure 22:
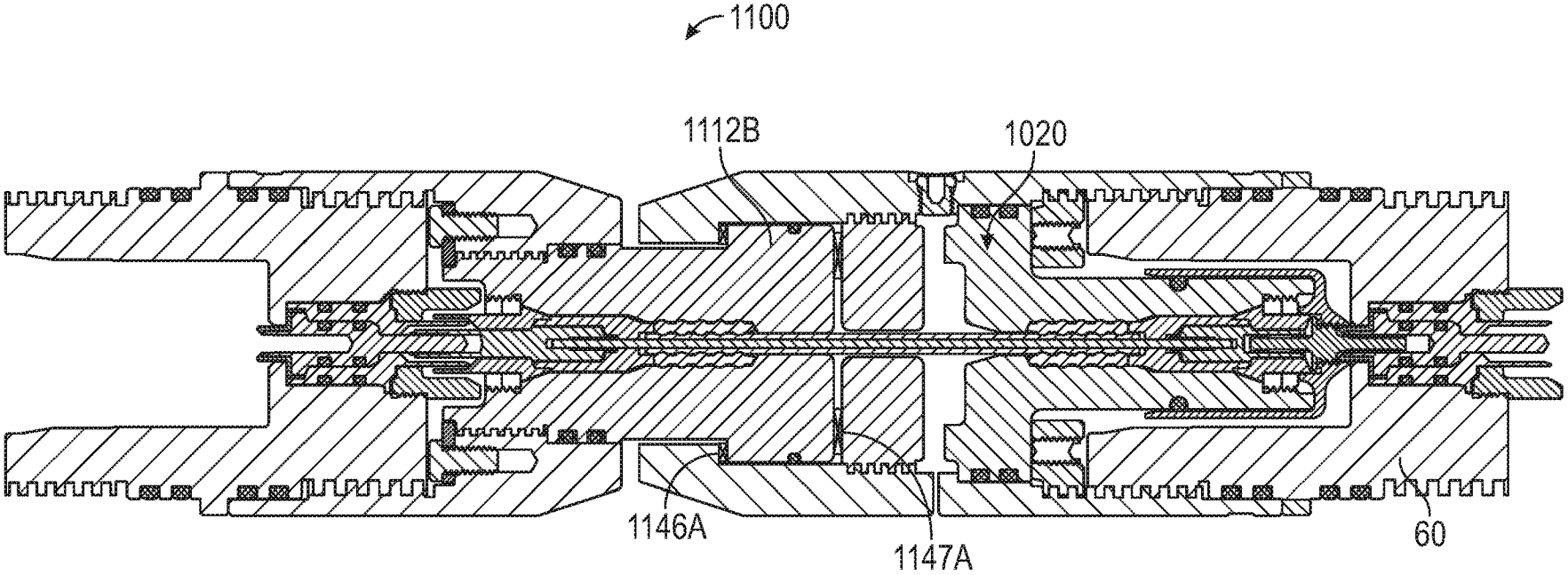
FIG. 22 is a cross-sectional view of an alternative arrangement for a swivel coupling that is similar to swivel coupling shown in FIG. 21 having limited bend flexibility while allowing unlimited relative rotation between the coupled ends.

Turning to FIG. 22, an alternate arrangement for an articulable coupling in the form of a swivel coupling or swivel head is shown by arrow 1100. Rather than a ball and socket, the ball has shape more like a hockey puck with a shoulder for pulling in tension and a flat opposite end for compression loads. Thrust bearings 1146A and 1147A arranged to allow rotation while enduring substantial compression or tensile loads.

Figure 23:
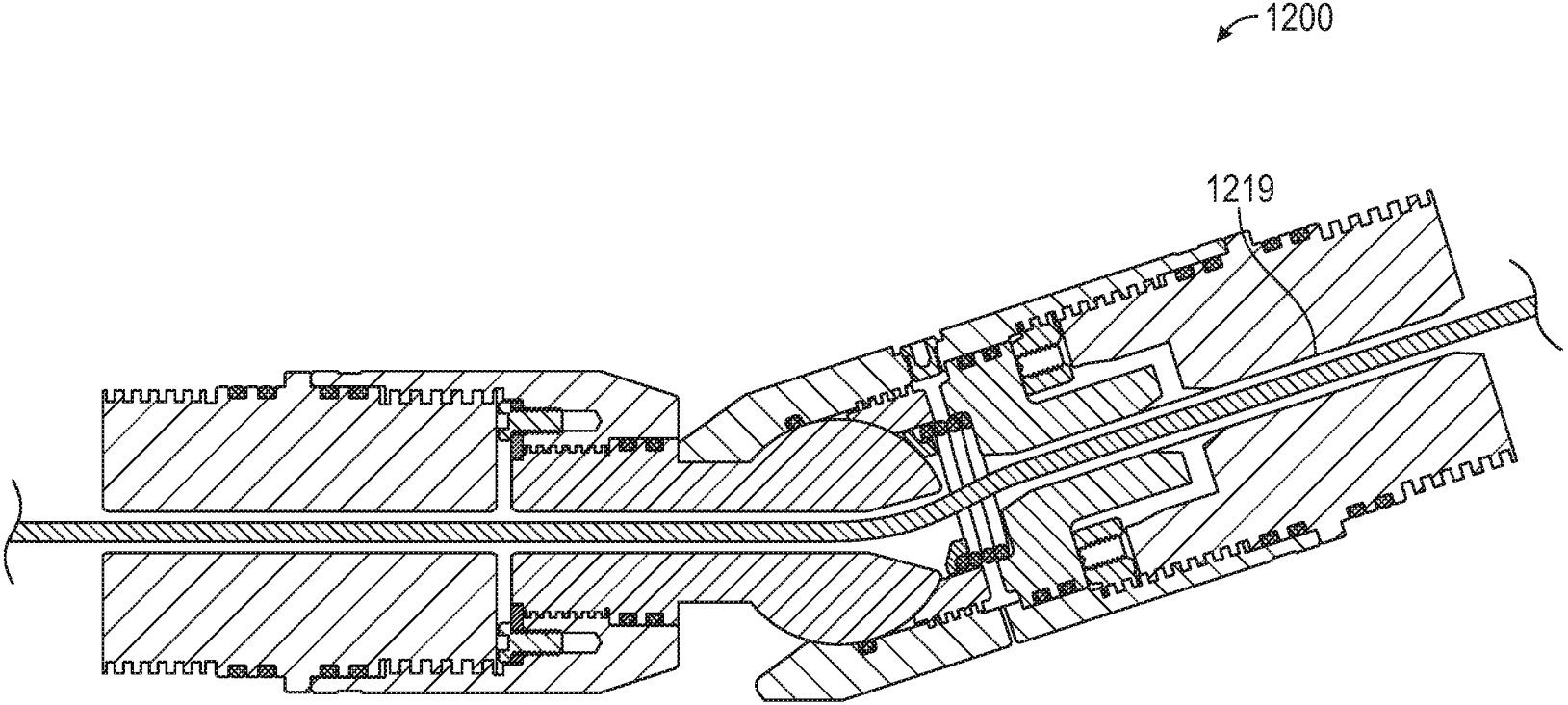
FIG. 23 is cross-sectional view of an over the wire coupling similar to articulable coupling embodiments shown in FIGS. 6-14 for use in wireline operations.
Figure 24:
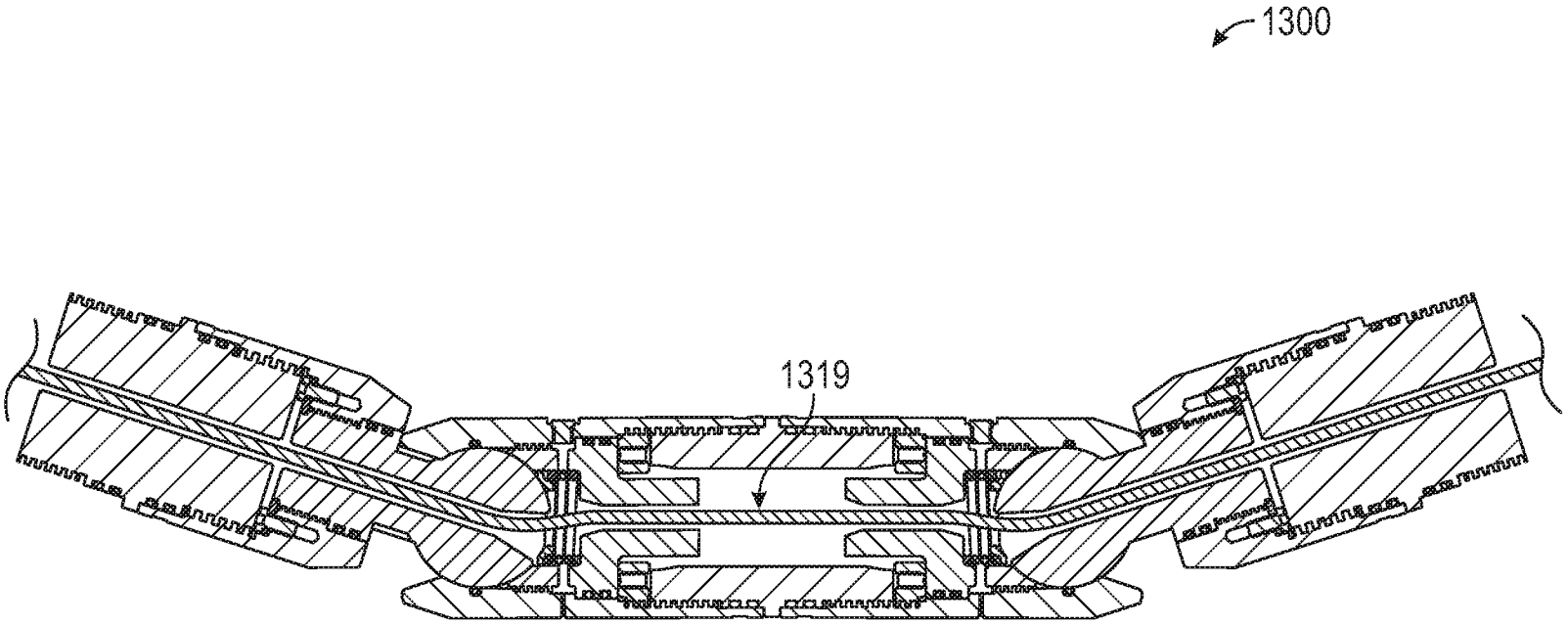
FIG. 24 is a cross-sectional view of an over the wire coupling similar to articulable coupling embodiments shown in FIGS. 15 and 16 for use in wireline operations.

In FIGS. 23 and 24, internal electrical connections are eliminated in favor of an "over the wire" design with a wireline 1219 passing entirely through the bore of articulable coupling 1200 in FIG. 23 and wireline 1319 passing through the bore of multi ball over the line articulable coupling 1300 in FIG. 24.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein.

Figure 25:
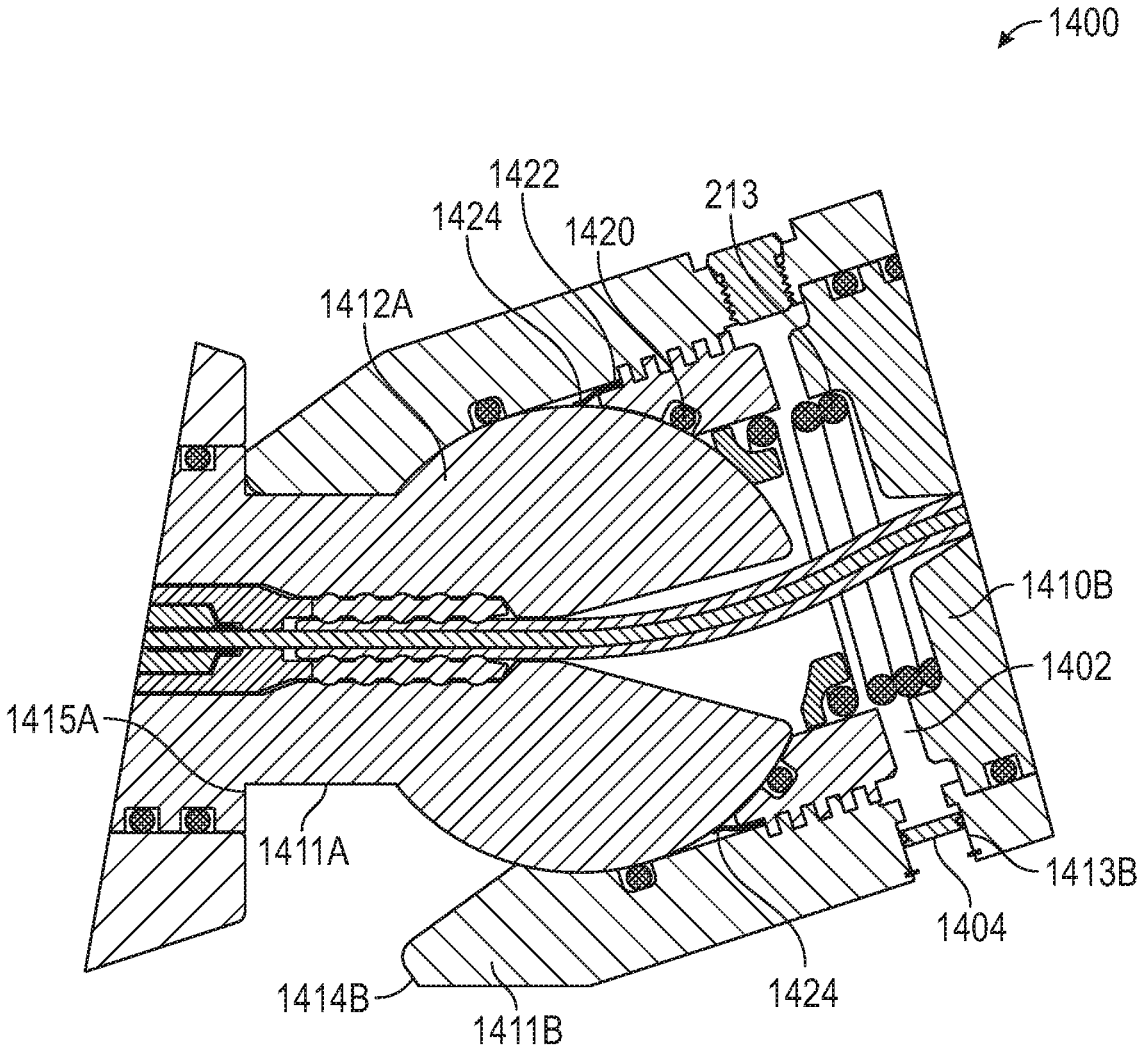
FIG. 25 is a fragmentary cross-sectional view of an articulated coupling.

Another embodiment of an articulable coupling 1400 is shown in FIG. 25 that is similar in configuration to the articulable coupling shown in FIG. 20. Particularly, in this exemplary embodiment, an internal chamber 1402 defined by cover sleeve 1411B is at least partially filled with one or more lubricants or grease and is sealed from the external environment via a floating piston 1404 positioned in a corresponding radial port 1413B formed in the cover sleeve 1411B. Floating piston 1404 is permitted to freely float or translate within the radial port 1413B whereby fluid pressure may be equalized between the internal chamber 1402 and the external environment while, at the same time, sealing the internal chamber 1402 from the external environment.

Additionally, in this exemplary embodiment, the cover sleeve 1411B of articulable coupling 1400 also includes a tapered or inclined shoulder 1414B defining a terminal end thereof. The inclined shoulder 1414B is configured to contact a corresponding annular shoulder 1415A formed by neck 1411A along an annular contact plane having a non-zero radial width. In this manner, the stress applied to cover sleeve 1411B and/or neck 1411A as a result of contact therebetween may be minimized. Further, an additional annular seal 1420 (e.g., an O-ring seal) seals the annular interface formed between ball 1412A and an inner surface of bravo body 1410B to assist in sealing the internal chamber 1402 from the external environment.

In this exemplary embodiment, articulable coupling 1400 includes an electrically conductive, annular ground spring 1422 coupled to (e.g., in electrical contact with) a terminal end of the bravo body 1410B. The ground spring 1422 includes an annular base coupled to the bravo body 1410B and a plurality of circumferentially spaced fingers 1424 that extend from the annular base and are biased radially inwards into electrical contact with the ball 1412A. In some embodiments, the ground spring 1412 may form part of an electrical ground pathway (e.g., in parallel with the electrical contact provided by ground spring 213) of the articulable coupling 1400 to ensure electrical connectivity is maintained thereallong.

Figure 26:
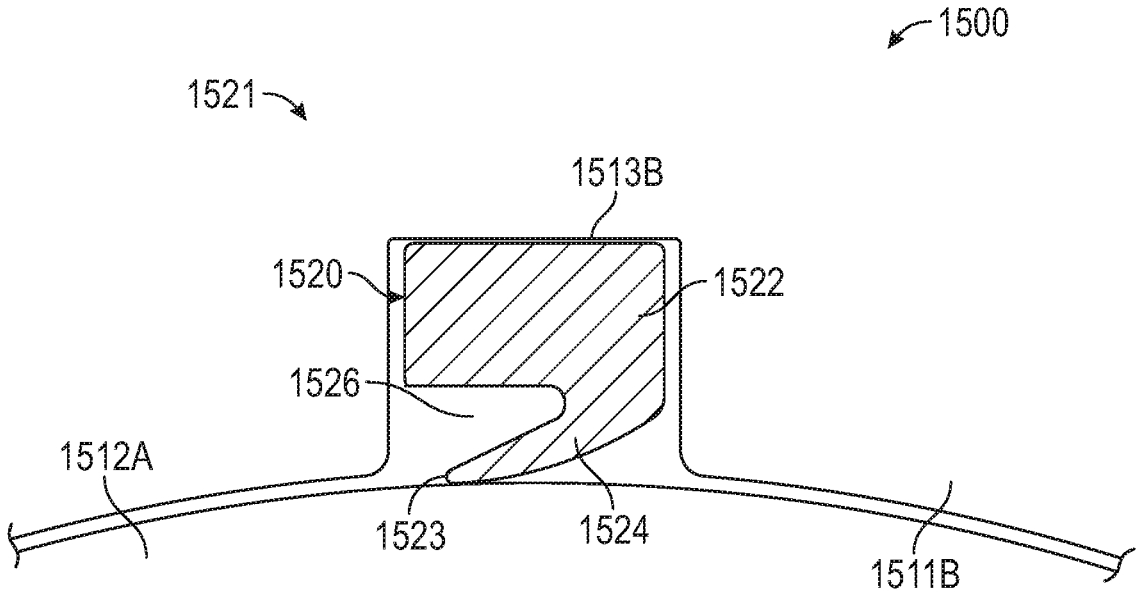
FIG. 26 is a fragmentary cross-sectional view of another embodiment of an articulated coupling.

Referring to FIG. 26, another embodiment of an articulable coupling 1500 is shown that is similar to many of the embodiments of articulable couplings described herein. In this exemplary embodiment, the cover sleeve 1511B includes an annular seal groove 1513B that opposes ball 1512A. An annular seal 1520 is positioned in the seal groove 1513B that sealingly engages the ball 1512B to seal the interface formed between cover sleeve 1511B and ball 1512A. In this exemplary embodiment, seal 1520 is configured to increase the sealing or contact pressure applied thereby to the cover sleeve 1511B and ball 1512A in response to an increase in fluid pressure in the external environment (e.g., an increase in wellbore pressure) to prevent the ingress of wellbore fluids (e.g., containing debris and other solids) across or along the interface formed between cover sleeve 1511B and ball 1512A.

Particularly, in this exemplary embodiment, seal 1520 generally includes a base 1522 defining a radially outer end 1521 of the seal 1520 and a flap 1524 that extends from the base 1522 and defines a radially inner end 1523 of seal 1520. Flap 1524 is flexibly coupled to the base 1522 with an annular groove 1526 formed therebetween and which may be in fluid communication with the external environment. As fluid pressure in the external environment increases, fluid pressure similarly increases within the groove 1526 which, in turn, increases both the sealing pressure or contact force applied by base 1522 against the cover sleeve 1511B and the sealing pressure or contact force applied by flap 1524 to the ball 1512, enhancing the sealing integrity of seal 1520.

The relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. An articulable assembly for connecting tools in a downhole tool string comprising:

a first member having a first throughbore;

a second member having a second throughbore;

a flexible joint coupled between the first member and the second member that permits at least one of the first member and the second member to articulate freely relative to the other and that also connects the first throughbore and the second throughbore such that an electrical signal pathway for receiving an electrical signal conductor is formed that extends continuously through the flexible joint and between the first throughbore and the second throughbore; and a pressure bulkhead coupled to at least one of the first member, the second member, or the flexible joint and positioned along the electrical signal pathway that divides the electrical signal pathway into a pressure exposed zone that is exposed to external pressure from the surrounding environment and a pressure isolated zone that is isolated from the external pressure, and wherein the pressure bulkhead comprises an electrical connector for transmitting electrical signals along the electrical signal pathway and between the pressure isolated zone and the pressure isolated zone such that the articulable assembly may electrically connect to tools connectable to the first member and the second member.

2. The articulable assembly of claim 1, wherein the electrical signal conductor comprises a terminal connector connected to an end of the electrical signal conductor and axially insertable into a receptacle of the electrical connector of the pressure bulkhead.

3. The articulable assembly of claim 1, wherein the electrical connector of the pressure bulkhead comprises a spring contact positioned in a receptacle of the electrical connector to permit relative rotation between the electrical signal conductor and the electrical connector while permitting relative rotation between the signal conductor and the electrical connector.

4. The articulable assembly of claim 1, wherein the electrical connector comprises a seal collar that is external of a receptacle of the electrical connector and seals against the electrical signal conductor.

5. The articulable assembly of claim 1, further comprising the electrical signal conductor electrically connected to the electrical connector of the pressure bulkhead and extending along at least a portion of the pressure exposed zone of the electrical signal pathway.

6. The articulable assembly of claim 5, wherein the electrical signal conductor comprises a spring tempered wire.

7. The articulable assembly of claim 5, wherein the electrical signal conductor is encapsulated in an electrically insulative coating for at least a portion of its longitudinal length.

8. The articulable assembly of claim 5, wherein the electrical signal conductor is surrounded by an electrically insulating sleeve for at least a portion of its longitudinal length.

9. The articulable assembly of claim 8, wherein the electrical connector of the pressure bulkhead comprises a seal sleeve positioned in a receptacle of the electrical connector and which surrounds at least a portion of the electrically insulating sleeve.

10. The articulable assembly of claim 5, wherein the electrical connector of the pressure bulkhead permits relative rotation between the pressure bulkhead and the signal conductor while maintaining electrical connectivity therebetween.

11. An articulable assembly for connecting tools in a downhole tool string comprising:

a first member having a first throughbore;

a second member having a second throughbore;

a flexible joint coupled between the first member and the second member that permits at least one of the first member and the second member to articulate relative to the other, the flexible joint defining an internal lubricant chamber at least partially filled with a lubricant that is pressure equalized with pressure of external fluid present in the surrounding environment while also sealed from external fluid; and a pressure bulkhead coupled to at least one of the first member, the second member, or the flexible joint and positioned along the electrical signal pathway for isolating communication of fluid pressure between the first throughbore and the second throughbore.

12. The articulable assembly of claim 11, wherein the internal lubricant chamber is at least partially filled by a fluid sealant that seals the lubricant from the surrounding environment.

13. The articulable assembly of claim 11, wherein the flexible joint comprises a ball coupled to the first member and a socket coupled to the second member, and wherein the ball is ball is positioned in the socket in a slidable manner to permit articulation between the first member and the second member.

14. The articulable assembly of claim 13, wherein the flexible joint comprises a biasing member that is biased into contact with both the ball and the with second member to maintain electrical connectivity between the ball and the second member.

15. The articulable assembly of claim 11, wherein the flexible joint comprises:

a third member comprising a third throughbore along which at least a portion of the electrical signal pathway extends;

a first ball joint comprising a first ball and a first socket with the first ball slidably positioned in the first socket, wherein the first ball joint is coupled to a first end of the third member; and a second ball joint comprising a second ball and a second socket with the second ball slidably positioned in the second socket, wherein the second ball joint is coupled to a second end of the third member.

16. The articulable assembly of claim 11, wherein:

the flexible joint divides the electrical signal pathway into a pressure exposed zone that is exposed to external pressure from the surrounding environment and a pressure isolated zone that is isolated from the external pressure; and the flexible joint comprises a third member that is connected between the first member and the second member, and wherein at least a portion of the pressure exposed zone of the electrical signal pathway extends through a third throughbore of the third member.

17. The articulable assembly of claim 16, wherein the third member comprises a spider of a universal joint.

18. The articulating assembly of claim 11, further comprising:

a second pressure bulkhead with a pressure exposed zone that is exposed to external pressure from the surrounding environment extending between the bulkheads; and an electrical signal conductor extending between and electrically connected to the electrical connectors of the pressure bulkheads.

19. An articulable assembly for connecting tools in a downhole tool string comprising:

a first member having a first throughbore;

a second member having a second throughbore; and a flexible joint coupled between the first member and the second member that permits at least one of the first member and the second member to rotate relative to the other and that also connects the first throughbore and the second throughbore such that an electrical signal pathway for receiving an electrical signal conductor is formed that extends continuously through the flexible joint and between the first throughbore and the second throughbore, the flexible joint comprising a ground biasing member that forms at least part of an electrical ground pathway through the flexible joint that is separate from the electrical signal pathway.

20. The articulable assembly of claim 19, wherein the electrical signal pathway is at least partially filled with a high viscosity fluid.

21. The articulable assembly of claim 19, wherein the flexible joint is coupled to the first member at a first threaded connection and at one or more second threaded connections that are reverse threaded relative to the first threaded connection.

22. A swivel assembly for connecting tools in a downhole tool string, comprising:

a first member having a first throughbore;

a second member having a second throughbore;

a flexible joint coupled between the first member and the second member that permits at least one of the first member and the second member to rotate an unlimited number of rotations relative to the other and that also connects the first throughbore and the second throughbore such that an electrical signal pathway for receiving an electrical signal conductor is formed that extends continuously through the flexible joint and between the first throughbore and the second throughbore; and a pressure bulkhead coupled to at least one of the first member, the second member, or the flexible joint and positioned along the electrical signal pathway that divides the electrical signal pathway into a pressure exposed zone that is exposed to external pressure from the surrounding environment and a pressure isolated zone that is isolated from the external pressure, and wherein the pressure bulkhead comprises an electrical connector for transmitting electrical signals along the electrical signal pathway and between the pressure isolated zone and the pressure isolated zone such that the swivel assembly may electrically connect to tools connectable to the first member and the second member.

23. The swivel assembly of claim 22, wherein the flexible joint permits the at least one of the first member and the second member to rotate relative to the other about only a single rotation axis.

24. An articulable coupling for connecting tools in a downhole tool string comprising:

a first member having a throughbore;

a second member having a throughbore;

a flexible joint between the first and second members which allows at least one of the first and second members to articulate relative to the other and wherein the respective throughbores of the first and second members are connected such that at a wireline cable may be arranged to extend from end to end of the articulable coupling through the throughbore of one of the members to and through the throughbore of the other;

a high viscosity fluid in the throughbores to resist intrusion of wellbore fluids that may carry wear imposing debris onto bearing surfaces creating freedom of articulation thereby prolonging the life of the articulable coupling; and a pressure bulkhead coupled to at least one of the first member, the second member, or the flexible joint and positioned along the wireline cable to form a pressure exposed zone that is exposed to external pressure from the surrounding environment and a pressure isolated zone that is isolated from the external pressure.

* * * * *